US005341432A

United States Patent [19]

Suzuki et al.

[11] Patent Number: 5,341,432

[45] Date of Patent: Aug. 23, 1994

[54] APPARATUS AND METHOD FOR PERFORMING SPEECH RATE MODIFICATION AND IMPROVED FIDELITY

[75] Inventors: Ryoji Suzuki, Nara; Masayuki Misaki, Hirakata, both of Japan

[73] Assignee: Matsushita Electric Industrial Co., Ltd., Kadoma, Japan

[21] Appl. No.: 993,526

[22] Filed: Dec. 16, 1992

Related U.S. Application Data

[63] Continuation of Ser. No. 593,209, Oct. 4, 1990, abandoned.

[30] Foreign Application Priority Data

| | | | |
|---|---|---|---|
| Oct. 6, 1989 | [JP] | Japan | 1-262391 |
| Jan. 24, 1990 | [JP] | Japan | 2-13857 |
| Aug. 23, 1990 | [JP] | Japan | 2-223167 |

[51] Int. Cl.[5] ..... G10L 3/02

[52] U.S. Cl. ..... 381/34; 395/2.25

[58] Field of Search ..... 381/29–40; 360/8; 455/296; 395/2.2, 2.25, 2.26, 2.27

[56] References Cited

U.S. PATENT DOCUMENTS

| | | | |
|---|---|---|---|
| 3,786,195 | 1/1974 | Schiffman | 381/34 |
| 4,246,617 | 1/1981 | Portnoff | 360/32 |
| 4,464,784 | 8/1984 | Agnello | 381/34 |
| 4,597,318 | 7/1986 | Nikaido et al. | 381/51 |
| 4,815,135 | 3/1989 | Taguchi | 381/37 |
| 4,864,620 | 5/1989 | Bialick | 381/34 |
| 4,984,253 | 1/1991 | Trout | 455/296 |

FOREIGN PATENT DOCUMENTS 0197758 10/1986 European Pat. Off. .

OTHER PUBLICATIONS

Richard V. Cox, et al., "Real-Time Implementation of Time Domain Harmonic Scaling of Speech for Rate Modification and Coding" IEEE Transactions on Acoustics Speech and Signal Processing, vol. 31, Feb. 1983 pp. 258–259, 261–265.

John Makhoul, et al., "Time-Scale Modification to Low Rate Speech Coding" IEEE International Conference on Acoustics, Speech and Signal Processing, vol. 3, 1986; pp. 1705–1706.

P. Jianping, "Effective Time-Domain Method for Speech Rate-Change", IEEE Transactions on Consumer Electronics, vol. 34, No. 2, May 1988 pp. 339–346.

S. Roucos and A. M. Wilgus; "High Qualty Time-Scale Modification For Speech"; IEEE International Conference Acoustics, Signal Processing, Tampa Fla., Mar. 1985, pp. 493–496.

D. Malah; "Time-Domain Algorithms For Harmonic Bandwidth Reduction and Time Scaling Of Speech Signals" IEEE Transactions on Acoustics, Speech, and Signal Processing, Tampa, Fla.; vol. ASSP 27, No. 2; Apr. 1979; pp. 311—323.

*Primary Examiner*—Dale M. Shaw
*Assistant Examiner*—Kee M. Tung
*Attorney, Agent, or Firm*—Cushman, Darby & Cushman

[57] ABSTRACT

In a speech rate modification system and method, correlation functions between different segments of input speech signal are computed by a correlator (17), the amplitude of the input signal is controlled by two multipliers (19, 20) which multiply the input speech signal by an increasing window function and by a decreasing window function, or vice versa, respectively, produced by a window function generator (18), and then output signals of the multipliers (19, 20) are added to each other by an adder (21) at such a relative delay within one unitary segment (T) as to maximize the value of the correlation function, and the input voice signal and the output of the adder (21) are selected by a multiplier (22), to be issued as a rate-modified speech signal.

25 Claims, 23 Drawing Sheets

FIG. 3(b) $\alpha = 2.0$

FIG. 3(c) $\alpha = 3.0$

FIG. 4(b) $\alpha = 2.0$

FIG. 4(c) $\alpha = 3.0$

FIG. 6(b) $\alpha = 2/3$

FIG. 6(c) $\alpha = 0.5$

FIG.7(b) $\alpha = 2/3$

FIG.7(c) $\alpha = 0.5$

FIG. 9(b) $\alpha = 1/3$

FIG. 9(c) $\alpha = 1/4$

FIG.10(b) $\alpha = 1/3$

FIG.10(c) $\alpha = 1/4$

FIG.17(b) $\alpha = 2.0$

FIG.17(c) $\alpha = 3.0$

FIG. 18 (b) $\alpha = 2.0$

FIG. 18 (c) $\alpha = 3.0$

FIG. 20(b) $\alpha = 2/3$

FIG. 20(c) $\alpha = 0.5$

FIG. 21(b) $\alpha = 2/3$

FIG. 21(c) $\alpha = 0.5$

FIG. 23(b) $\alpha = 1/3$

FIG. 23(c) $\alpha = 1/4$

FIG. 24(b) $\alpha = 1/3$

FIG. 24(c) $\alpha = 1/4$

APPARATUS AND METHOD FOR PERFORMING SPEECH RATE MODIFICATION AND IMPROVED FIDELITY

This is a continuation of application Ser. No. 07/593,209, filed on Oct. 4, 1990, which was abandoned upon the filling hereof.

BACKGROUND OF THE INVENTION

1. Field of the Invention

The present invention relates to an apparatus for and a method of performing a speech rate modification in which only the time duration of speech is changed without altering the fundamental frequency components of the speech signal.

2. Description of the Prior Art

Heretofore, in order to perform a speeded-up listening or a slowed-down listening of speech signals recorded on audio tapes or the like, speech rate modification systems have been utilized.

Speech rate modification apparatus of prior art have included U.S. Pat. No. 3,786,195, to Schiffman et al., "Variable Delay Line Signal Processor for Sound Reproduction". This speech rate modification apparatus is comprised of a variable delay line, a ramp level and amplitude changer, a blanking circuit, a blanking pulse generator, and a ramp pulse-train generator.

The operation of the speech rate modification apparatus described above is elucidated below.

The input signal is first written into the variable delay line. Next, the ramp pulse-train generator controls the ramp level and amplitude changer and the blanking pulse generator corresponding to a time-scale modification ratio. Then the level and amplitude changer performs a read-out operation of signals from the variable delay line with a speed which is different from the speed used at the time of write-in operation and depends on the time-axis modification ratio. That is, when the reproduction rate of a tape is increased, the read-out operation of the data from a memory is made slower than the write-in operation to the memory in order to restore raised tone (frequencies) to normal levels; whereas when the reproduction rate of a tape is decreased, the read-out operation of the data from the memory is made faster than the write-in operation of the data to the memory in order to restore lowered tones to normal tones. Then, on discontinuous parts between respective speech blocks, the blanking circuit applies a muting action on the output of the variable delay line.

In the conventional constitution as has been described above, however, when increasing the rate, degradations in the recognizability of consonants necessarily occur owing to the practice of thinning data which is necessary for increasing the rate. And because of the above-mentioned muting, signal amplitude becomes discontinuous, causing the problem that only a speech voice having a poor naturalness can be obtained.

Although there is other means using detection of pitch period, apart from the above-mentioned conventional speech rate modification apparatus, such pitch detection methods can not be applied for the case that background music or noise superimposes on speech to be processed because the extraction of pitch is difficult in such case. Hence the above-mentioned method cannot be considered very suitable.

OBJECT AND SUMMARY OF THE INVENTION

The purpose of the present invention is to offer a speech rate modification apparatus which is capable of issuing a speech voice having an ample naturalness with less data drop-offs.

In order to achieve the above-mentioned purpose, a speech rate modification apparatus of the present invention comprises a correlator for computing a correlation function between different segments of input signal, a multiplier for controlling the amplitude of the signal, an adder for carrying out the addition calculation of signals at a time point at which the correlation function takes a largest value within a time-length of unitary segment based on the output from the above-mentioned correlator, and a selection circuit for switching over between the input signal and the output of the above-mentioned adder.

According to the constitution described above, in consequence of controlling the signal amplitude by the multiplier, the discontinuities of signal amplitude or the drop-offs of data become less, and also in consequence of the addition calculation of signals by the correlator and the adder at a time point at which the correlation function takes a largest value, discontinuities in phase also become less. And furthermore, in consequence of the control of segments by which the input signal is directly issued through selection circuits, a wide range of desired time-scale modification ratios are obtainable.

BRIEF DESCRIPTION OF THE DRAWINGS

These and other objects of this invention will become apparent and more readily appreciated from the following description of the presently preferred exemplary embodiments, taken in conjunction with the accompanying drawings.

It will be recognized that some or all of the Figures are schematic representations for purposes of illustration and do not necessarily depict the actual relative sizes or locations of the elements shown.

DESCRIPTION OF THE PREFERRED EMBODIMENTS

The purpose of the present invention is to offer a speech rate modification apparatus which is capable of giving a speech voice having an ample naturalness with less discontinuities in signal amplitude and phase and also with less data drop-offs and also which can be realized with simple hardware.

FIRST EMBODIMENT

In the following, elucidation is given on the first embodiment of a speech rate modification of the present invention referring to FIG. 1.

Figure 1:
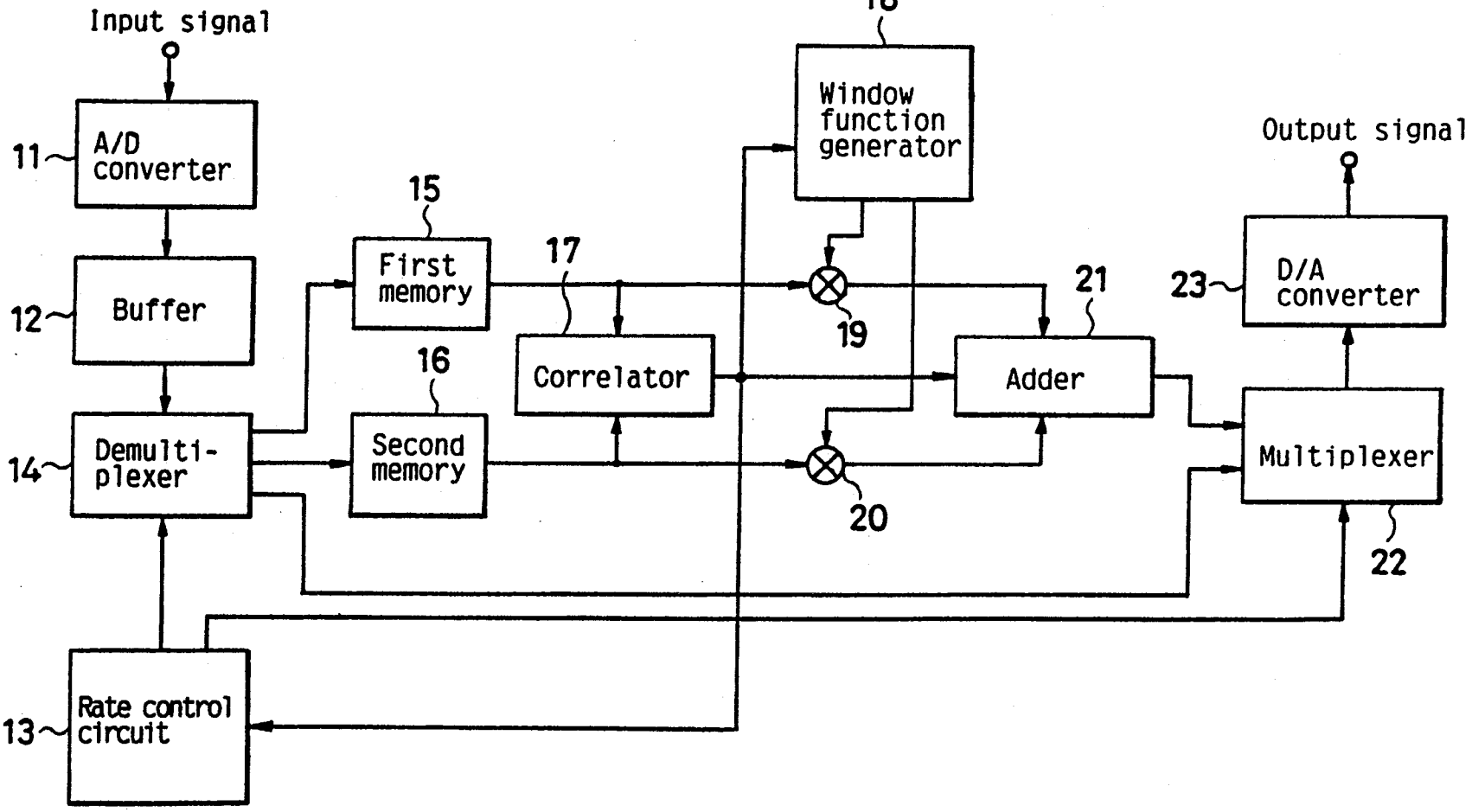
FIG. 1 is a block diagram of a speech rate modification apparatus in a first embodiment of the present invention.

FIG. 1 is a block diagram of a speech rate modification apparatus in the present embodiment. In FIG. 1, numeral 11 is an A/D converter for converting an input voice signal to a digitized voice signal. A buffer 12 is for temporarily storing the digitized voice signal. A demultiplexer 14 switches to deliver the digitized voice signal to a first memory 15, to a second memory 16, and to a multiplexer 22, being controlled by a rate control circuit 13. A correlator 17 is for computing a correlation function between outputs of the first memory 15 and the second memory 16. Output terminals of the correlator 17 are connected to the rate control circuit 13, to an adder 21 and to a window function generator 18. A first multiplier 19 and a second multiplier 20 are for multiplying an output of the window function generator 18 by outputs of the first memory 15 and of the second memory 16, respectively. The output terminals of the multipliers 19 and 20 are connected to the adder 21 which adds outputs to each other and is controlled by the output of the correlator 17. The multiplexer 22 is for combining outputs from the adder 21 and the demultiplexer 14 under control of the rate control circuit 13. Then a D/A converter 23 is for converting the combined digital signal to an analog output signal.

On the speech rate modification apparatus constituted as has been described above, its operation is elucidated below.

First, the input signal is converted into a digital signal by the A/D converter 11 and written into the buffer 12. Next, the rate control circuit 13 controls the demultiplexer 14 in accordance with a given time-scale modification ratio to supply the data in the buffer 12 to the first memory 15 and the second memory 16, and also to the multiplexer 22. Then, correlation functions between the contents of the first memory 15 and that of the second memory 16 are computed by the correlator 17, and the information of these correlation computations is supplied to the rate control circuit 13, the window function generator 18, and the adder 21. The window function generator 18 generates a first window function which gradually increases or gradually decreases, based on the information from the correlator 17 and on a given time-scale modification ratio, and supplies it to the first multiplier 19. And window function generator 18 also issues a second window function which is complementary to the above-mentioned first window function, and supplies it to the second multiplier 20. Then the first multiplier 19 performs a multiplication calculation between the contents of the first memory 15 and the first window function issued from the window function generator 18; whereas the second multiplier 20 performs a multiplication calculation between the contents of the second memory 16 and the second window function issued also from the window function generator 18. The adder 21 performs an addition calculation between these windowed outputs from the first multiplier 19 and from the second multiplier 20 after displacing their mutual position making a relative delay so that the computed correlation function takes a largest value within a time-length of unitary segment, based on the information from the correlator 17. Also, the adder 21 supplies the sum output to the multiplexer 22. Then, the multiplexer 22 selects the output of the adder 21 and the output of the demultiplexer 14 and supplies the selected result to the D/A converter 23, which converts the resultant digital signal to an analog signal.

As has been described above, according to the present embodiment, by using the first multiplier 19 and the second multiplier 20, the contents of the first memory 15 and the contents of the second memory 16 are multiplied respectively by paired window functions. These paired window functions are complementary to each other, one being a gradually increasing window function and the other being a gradually decreasing window function, both generated from the window function generator 18. Then, those windowed outputs from respective multipliers are added to each other by the adder 21, thus making a digitized speech voice having an ample naturalness with less discontinuities in the signal amplitude and also with relatively small data drop-offs. The correlator 17 computes a correlation function between the contents of the first memory 15 and the contents of the second memory 16. The adder 21 performs an addition calculation between the outputs from the first multiplier 19 and from the second multiplier 20 after displacing their mutual position to make delay so that the computed correlation function takes a largest value within a time-length of unitary segment. Thus, a high quality speech voice signal with less discontinuities in the signal phase can be obtained. Moreover, the length of segments in which the input signal is directly issued is controlled by the action of the rate control circuit 13, the demultiplexer 14 and the multiplexer 22. Thereby, the time-scale modification ratio can easily be changed. At the same time, according to the above-mentioned controlling, it becomes possible to rapidly absorb such deviations in the time-scale modification ratio that might be caused by the addition calculation performed by displacing the mutual position of those windowed signals to make the correlation function take a largest value within a time-length of unitary segment.

In the following, elucidation is given on the first embodiment of the speech rate modification method of the present invention referring to the accompanying drawings, FIG. 2 through FIG. 4.

The purpose of this invention is to offer a method of speech rate modification which is capable of giving a speech voice having an ample naturalness with less discontinuities in signal amplitude and phase and also with less data drop-offs for a time-scale modification ratio of $\alpha \geqq 1.0$.

Hereupon, the time-scale modification ratio $\alpha$ is defined as $$\text{Time-Scale modification Ratio: } \alpha = \frac{\text{Reproduction Time Duration after Time-Scale modification}}{\text{Reproduction Time Duration at Normal Rate}} \quad (1)$$

Figure 2:
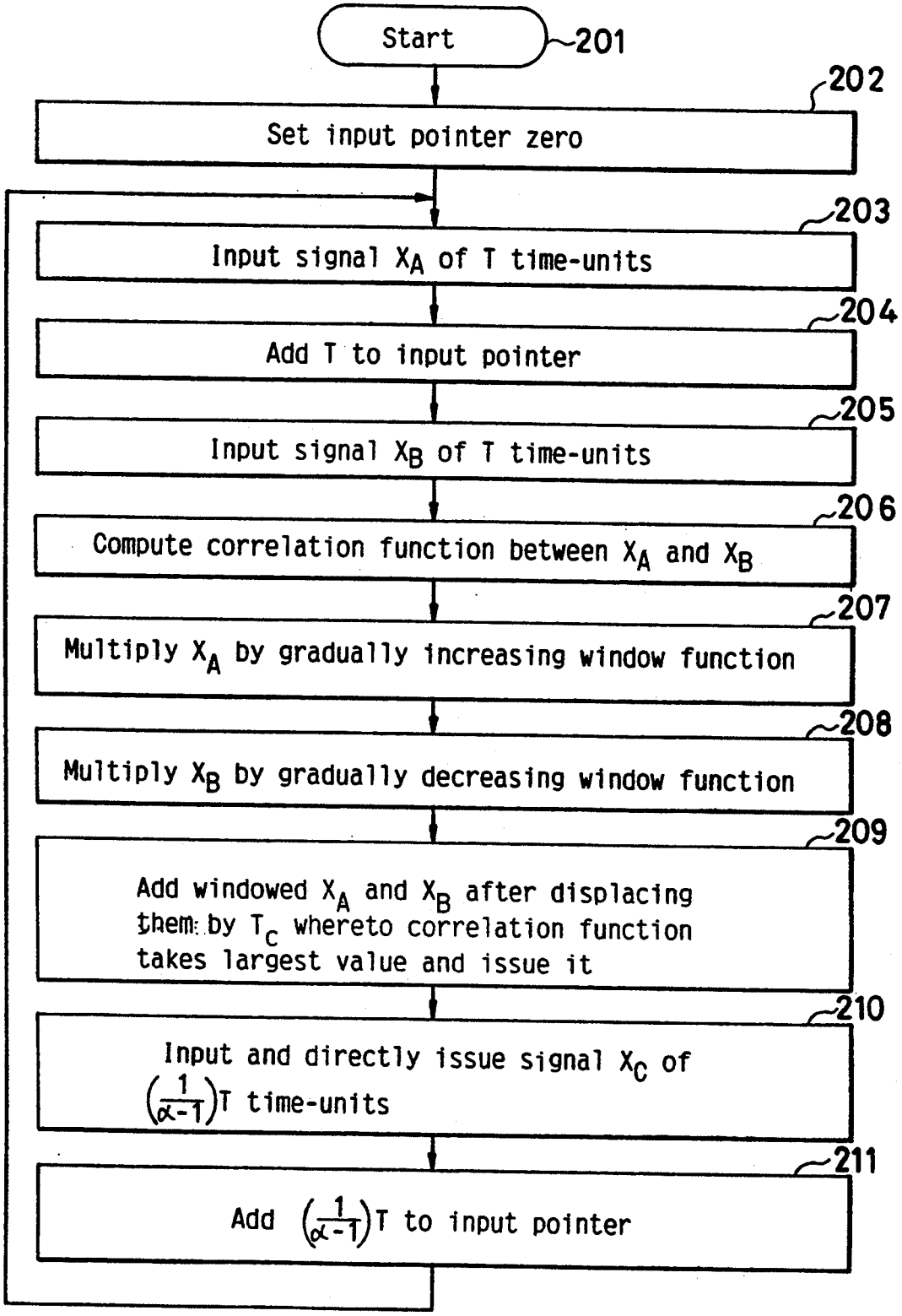
FIG. 2 is a flow chart representing a speech rate modification method in a first embodiment of the present invention.
Figure 3A:
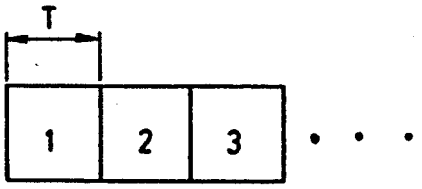
FIGS. 3(*a*)–3(*e*) show schematic diagram of processing voice waveforms in accordance with the speech rate modification method in the first embodiment of the present invention.
Figure 3A:
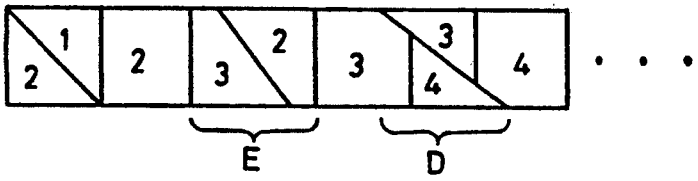
Figure 3A:
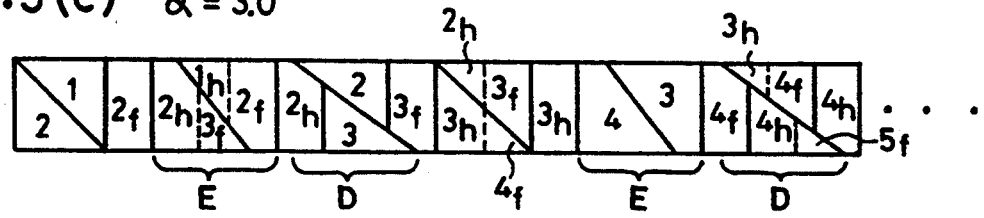
Figure 3D:
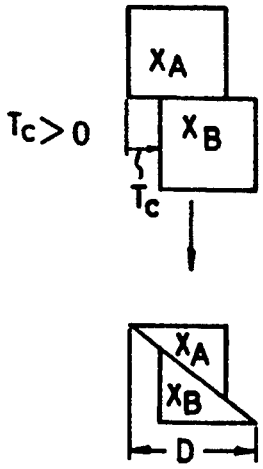
Figure 3E:
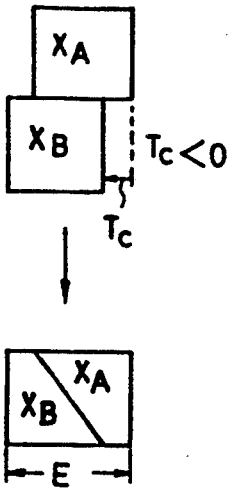
Figure 4A:
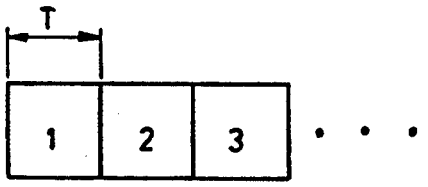
FIGS. 4(*a*)–4(*e*) show schematic diagram of processing voice waveforms in accordance with the speech rate modification method in the first embodiment of the present invention.
Figure 4A:
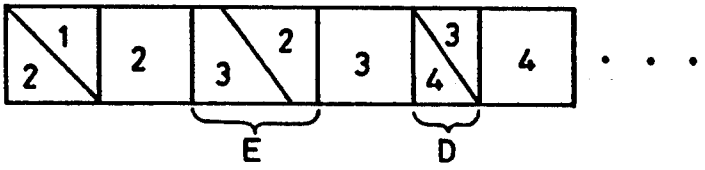
Figure 4A:
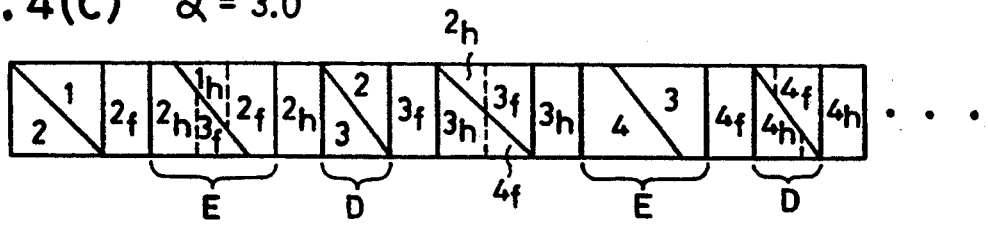
Figure 4D:
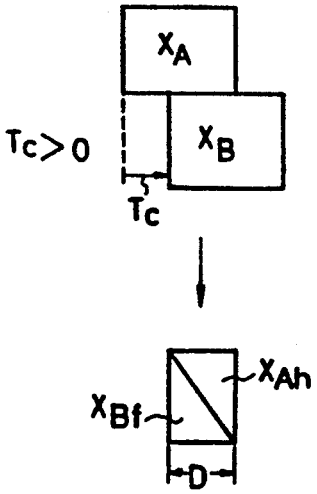
Figure 4E:
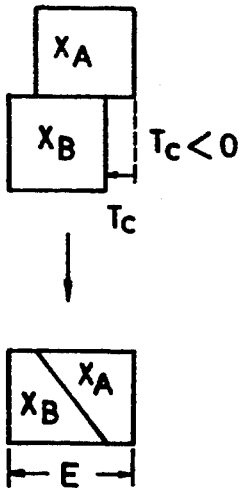

FIG. 2 is a flow chart representing a speech rate modification method in the present embodiment. Its operation is elucidated below.

First, an input pointer is reset (step 202). Then, a signal $X_A$ having a time-length as long as T time-units starting from a time point designated by this input pointer is inputted from the demultiplexer 14 to the first memory 15 (step 203). Then, T is added to the input pointer to update it (step 204). Next, a signal $X_B$ having thus the same time-length as long as T time-units starting from a time point designated by this updated input pointer is inputted from the demultiplexer 14 to the second memory 16 (step 205). Then a correlation function between $X_A$ and $X_B$ is computed (step 206). Based on this correlation function thus obtained, $X_A$ is multiplied by a window of a gradually increasing function (step 207). Also based on this correlation function obtained, $X_B$ is multiplied by a window of a gradually decreasing function (step 208). Then based also on the correlation function obtained, these windowed signals $X_A$ and $X_B$ are displaced relative to each other by a number of time units $T_c$ (as shown also in FIG. 3) so that the correlation function between $X_A$ and $X_B$ takes a largest value within a time-length of unitary segment and they are added, issuing the added result (step 209). Next, a signal $X_C$, which has a time-length of $T/(\alpha-1)$ time-units from a time point designated by the updated input pointer, is inputted from the demultiplexer 14 and directly issued to the multiplexer 22 (step 210). Then $T/(\alpha-1)$ is added to the input pointer to update it (operation 211). Then, step returns to the step 203 so long as further data exists that needs to be processed.

FIG. 3 schematically illustrates actual exemplary cases, wherein the horizontal direction corresponds to the time lapse and the vertical heights corresponds to the amplitude level of voice signal. FIG. 3(*a*) schematically shows a succession of segments, designated by 1, 2, 3, . . . each having a time-length of T time-units of an original voice signal on which a speech rate modification process is to be carried out. FIGS. 3(*b*) and 3(*c*) respectively schematically represent embodiments that the time-scale modification ratios $\alpha$ are 2.0 and 3.0, respectively. In FIG. 3(*c*), f stands for the fore part of a segment, while h stands for the hind part thereof. FIGS. 3(*d*) and 3(*e*) schematically illustrate examples of individual detailed process of the addition calculation. FIG. 3(*d*) illustrates a case of an addition calculation designated by D in FIG. 3(*b*) and FIG. 3(*c*), wherein the addition calculation is done under a condition that the correlation function takes a largest value when $X_B$ is displaced to the positive side by $T_c$ time-units with respect to $X_A$, resulting in extension of arise time sections outside the leading and rear edges of their overlapping time interval. FIG. 3(*e*) illustrates another case of an addition calculation designated by E in FIG. 3(*b*) and in FIG. 3(*c*), wherein the addition calculation for the same condition is done when $X_B$ is displaced to the negative side by $T_c$ time-units with respect to $X_A$. In the exemplary cases shown in FIGS. 3(*b*) and 3(*c*), there are time intervals designated by D which correspond to the time interval D of FIG. 3(*d*). In these time intervals, time sections extending outside the overlapping time interval may overlap also to adjacent time intervals and hence it is necessary to perform the amplitude adjustments also in those adjacent time intervals.

Hereinafter, also in FIGS. 4, 6, 7, 9, 10, 12, 17, 18, 20, 21, 23, and 24, the same convention as has been employed in FIG. 3 is applied.

As has been described above, according to the present embodiment, signals $X_A$ and $X_B$ are multiplied respectively by window functions which are complementary to each other, one being a gradually increasing window function and the other being a gradually decreasing window function. A signal obtained by adding these windowed signals is inserted at a time point corresponding to the beginning of the input signal part $X_B$, and this process is repeated. Thus, a speech voice having an ample naturalness with less discontinuities in signal amplitude and also with less data drop-offs can be issued for a time-scale modification ratio of $\alpha \geqq 1.0$. By computing a correlation function between $X_A$ and $X_B$, and adding windowed signals $X_A$ and $X_B$ by displacing their mutual position so that the computed correlation function takes a largest value within a time-length of unitary segment, a high quality speech voice with less discontinuities in the signal phase is obtainable. Moreover, by changing the length of $X_C$, it becomes possible to easily change the time-scale modification ratio.

FIG. 4 schematically illustrates modified exemplary cases obtained by modifying the above-mentioned embodiment. FIG. 4(*a*) schematically shows a succession of segments 1, 2, 3, . . . each having a time-length of T time-units of an original voice signal on which the speech rate modification process is to be carried out. FIG. 4(*b*) and FIG. 4(*c*) schematically represent embodiments where the time-scale modification ratios $\alpha$ are 2.0 and 3.0, respectively, and FIG. 4(*d*) and FIG. 4(*e*) schematically illustrate examples of detailed individual process of the addition calculation. FIG. 4(*d*) illustrates a case of addition calculation designated by D in FIG. 4(*b*) and FIG. 4(*c*), wherein the addition calculation is done under a condition that the correlation function takes a largest value when $X_B$ is displaced to the positive side by $T_c$ time-units with respect to $X_A$ and time sections extending outside the leading and rear edges of the overlapping time interval are discarded. FIG. 4(*e*) illustrates another case of addition calculation, designated by E in FIG. 4(*b*) and FIG. 4(*c*), wherein the addition calculation for the same condition is done when $X_B$ is displaced to the negative side by $T_c$ time-units with respect to $X_A$. In these exemplary cases shown in FIGS. 4(*b*) and (*c*), too, there are time intervals designated by D which correspond to the time interval D of FIG. 4(*d*). In these time intervals, time sections extending outside the overlapping time interval are discarded as shown in FIG. 4(*d*). This modified method can be realized by changing the window function. This modified method enables realizing a simplification of process as described above without suffering a degradation in the recognizability of the speech voice.

In the following, elucidation is given on the second embodiment of the speech rate modification method of the present invention referring to FIGS. 5 through 7.

The purpose of this embodiment is to offer a method of speech rate modification which is capable of giving a speech voice having an ample naturalness with less discontinuities in signal amplitude and phase and also with less data drop-offs for a time-scale modification ratio of $0.5 \leqq \alpha \leqq 1.0$.

Figure 5:
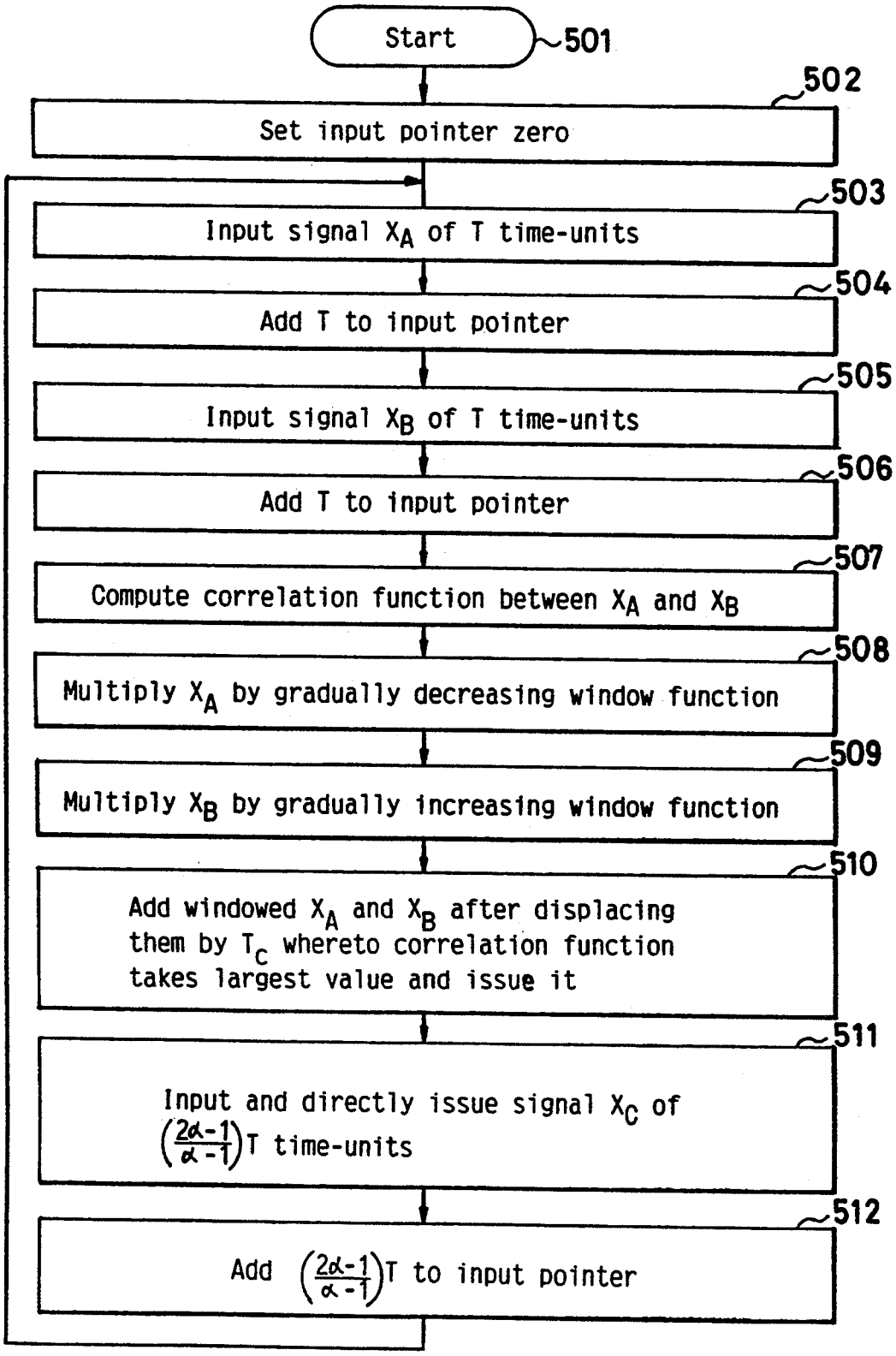
FIG. 5 is a flow chart representing a speech rate modification method in a second embodiment of the present invention.
Figure 6A:
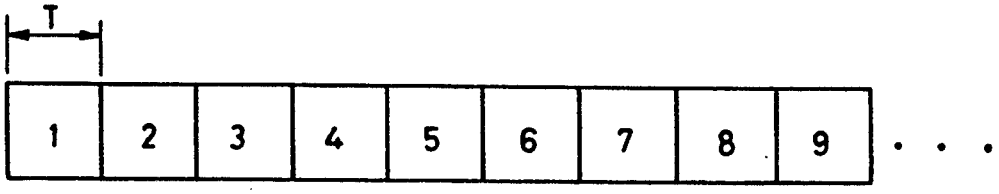
FIGS. 6(*a*)–6(*e*) show schematic diagram of processing voice waveforms in accordance with the speech rate modification method in the second embodiment of the present invention.
Figure 6A:
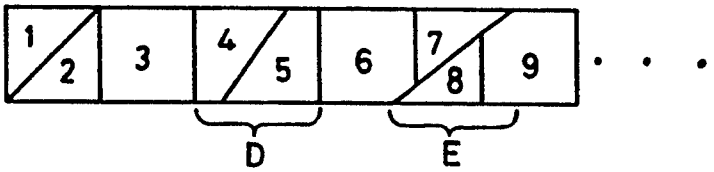
Figure 6A:
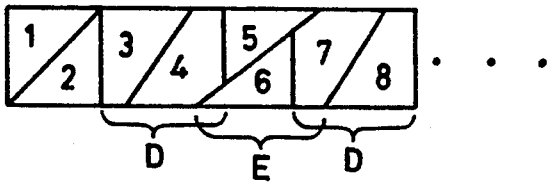
Figure 6D:
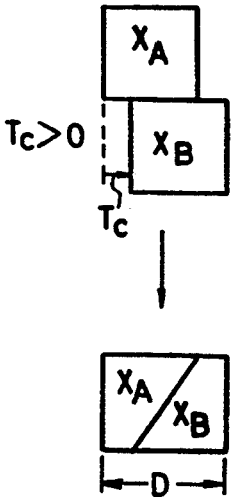
Figure 6E:
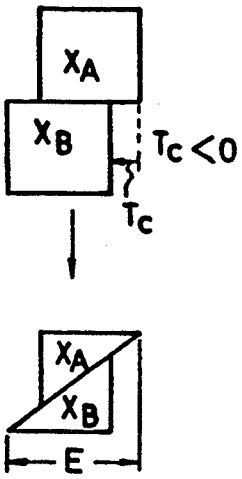
Figure 7A:
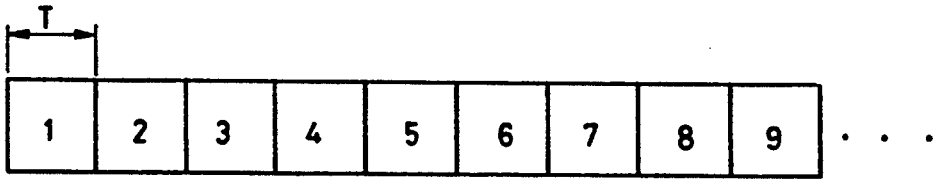
FIGS. 7(*a*)–7(*e*) show schematic diagram of processing voice waveforms in accordance with the speech rate modification method in the second embodiment of the present invention.
Figure 7A:
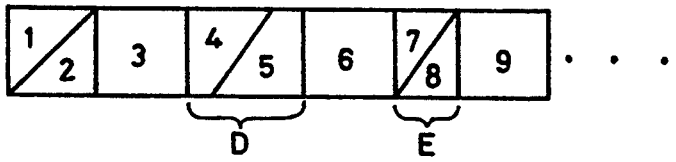
Figure 7A:
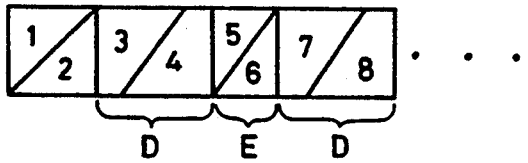
Figure 7D:
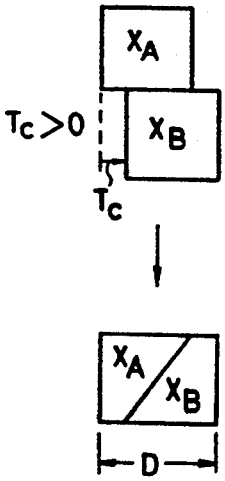
Figure 7E:
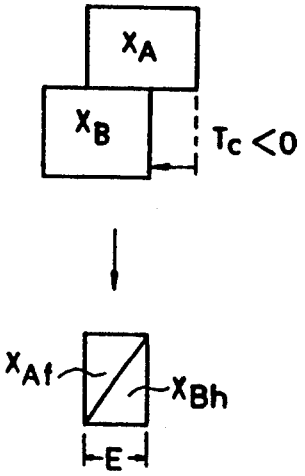

FIG. 5 shows a flow chart representing a speech rate modification method in the present embodiment, and the same hardware as shown in FIG. 1 is used. Its operation is elucidated below.

First, an input pointer is reset (step 502). Then, a signal $X_A$ having a time-length as long as T time-units starting from a time point designated by this input pointer is inputted (step 503). Then, T is added to the input pointer to update it (step 504). Next, a signal $X_B$ having thus the same time-length as long as T time-units starting from a time point designated by this updated input pointer is inputted (step 505). T is added to the input pointer to update it (step 506). Then a correlation function between $X_A$ and $X_B$ is computed (step 507). Based on this correlation function thus obtained, $X_A$ is multiplied by a window of a gradually decreasing function (step 508). Also based on this correlation function obtained, $X_B$ is multiplied by a window of a gradually increasing function (step 509). Then based also on the correlation obtained, these windowed signals $X_A$ and $X_B$ are added to each other after they are mutually displaced at a time point at which the correlation function takes a largest value within a time-length of unitary segment and the added result is issued (step 510). Next, a signal $X_C$ having a time-length of $(2\alpha-1)T/(\alpha-1)$ time-units starting from a time point designated by the updated input pointer is inputted and directly issued (step 511). Then $(2\alpha-1)T/(\alpha-1)$ is added to the input pointer to update it (operation 512). Then, step returns to the step 503.

FIG. 6 schematically represents actual exemplary cases, wherein FIG. 6(*a*) schematically shows a succession of segments each having a time-length of T time-units of original voice signals on which the speech rate modification process is to be carried out, and FIG. 6(*b*) and FIG. 6(*c*) schematically represent embodiments where the time-scale modification ratios $\alpha$ are $\frac{2}{3}$ and 0.5, respectively. And FIG. 6(*d*) and FIG. 6(*e*) schematically illustrate examples of individual detailed process of the addition calculation; FIG. 6(*d*) illustrates a case of an addition calculation designated by D in FIG. 6(*b*) and FIG. 6(*c*), wherein the addition calculation is performed under the condition that the correlation function takes a largest value when $X_B$ is displaced to the positive side by $T_c$ time-units with respect to $X_A$. FIG. 6(*e*) illustrates another case of addition calculation, designated by E in FIG. 6(*b*) and FIG. 6(*c*), wherein the addition calculation is done for the same condition is done when $X_B$ is displaced to the negative side by $T_c$ time-units with respect to $X_A$. In the exemplary cases shown in FIG. 6(*b*) and FIG. 6(*c*), there are time intervals designated by E which correspond to the time interval E of FIG. 6(*e*). In these time intervals, time sections extending outside the overlapping time interval may overlap also to adjacent time intervals and hence it is necessary to perform the amplitude adjustments also in those adjacent time intervals.

As has been described above, according to the present embodiment, signals $X_A$ and $X_B$ are multiplied respectively by window functions which are complementary to each other, one being a gradually decreasing window function and the other being a gradually increasing window function. A signal obtained by adding these windowed signals is issued and then the signal $X_C$ is issued, and this process is repeated. Thus, a speech voice having an ample naturalness with less discontinuities in signal amplitude and also with less data drop-offs can be issued for a time-scale modification ratio of $0.5 \leqq \alpha \leqq 1.0$. By computing a correlation function between $X_A$ and $X_B$, and adding windowed signals $X_A$ and $X_B$ by displacing their mutual position so that the computed correlation function takes a largest value within a time-length of unitary segment, a high quality speech voice with less discontinuities in its signal phase can be obtained. Moreover, by changing the length of $X_C$, it becomes possible to easily change the time-scale modification ratio.

FIG. 7 schematically illustrates modified exemplary cases obtained by modifying the above-mentioned embodiment, wherein FIG. 7(*a*) schematically shows a succession of segments each having a time-length of T time-units of an original voice signal on which the speech rate modification process is to be carried out, FIG. 7(*b*) and FIG. 7(*c*) schematically represent embodiments where the time-scale modification ratios $\alpha$ are $\frac{2}{3}$ and 0.5, respectively. FIG. 7(*d*) and FIG. 7(*e*) schematically illustrate examples of detailed individual processes of the addition calculation. FIG. 7(*d*) illustrates a case of the addition calculation designated by D in FIG. 7(*b*) and FIG. 7(*c*), wherein the addition calculation is done under a condition that the correlation function takes a largest value when $X_B$ is displaced to the positive side by $T_c$ time-units with respect to $X_A$. FIG. 7(*e*) illustrates another case of the addition calculation designated by E in FIG. 7(*b*) and FIG. 7(*c*), wherein the addition calculation for the same condition is done when $X_B$ is displaced to the negative side by $T_c$ time-units with respect to $X_A$ and time sections extending outside the leading and rear edges of the overlapping time interval are discarded. In these exemplary cases shown in FIG. 7(*b*) and FIG. 7(*c*), too, there are time intervals designated by E which correspond to the time interval E of FIG. 7(*e*). In these time intervals, time sections extending outside the overlapping time interval are discarded as shown in FIG. 7(*e*). This modified method can be realized by changing the window function. This modified method enables realizing a simplification of the process described above without suffering a degradation in the recognizability of the speech voice.

In the following, elucidation is given on the third embodiment of the speech rate modification method of the present invention referring to FIG. 8 through FIG. 10.

The purpose of this embodiment is to offer a method of speech rate modification which is capable of giving a speech voice having an ample naturalness with less discontinuities in signal amplitude and phase for a range of the time-scale modification ratio of $\alpha \leqq 0.5$.

Figure 8:
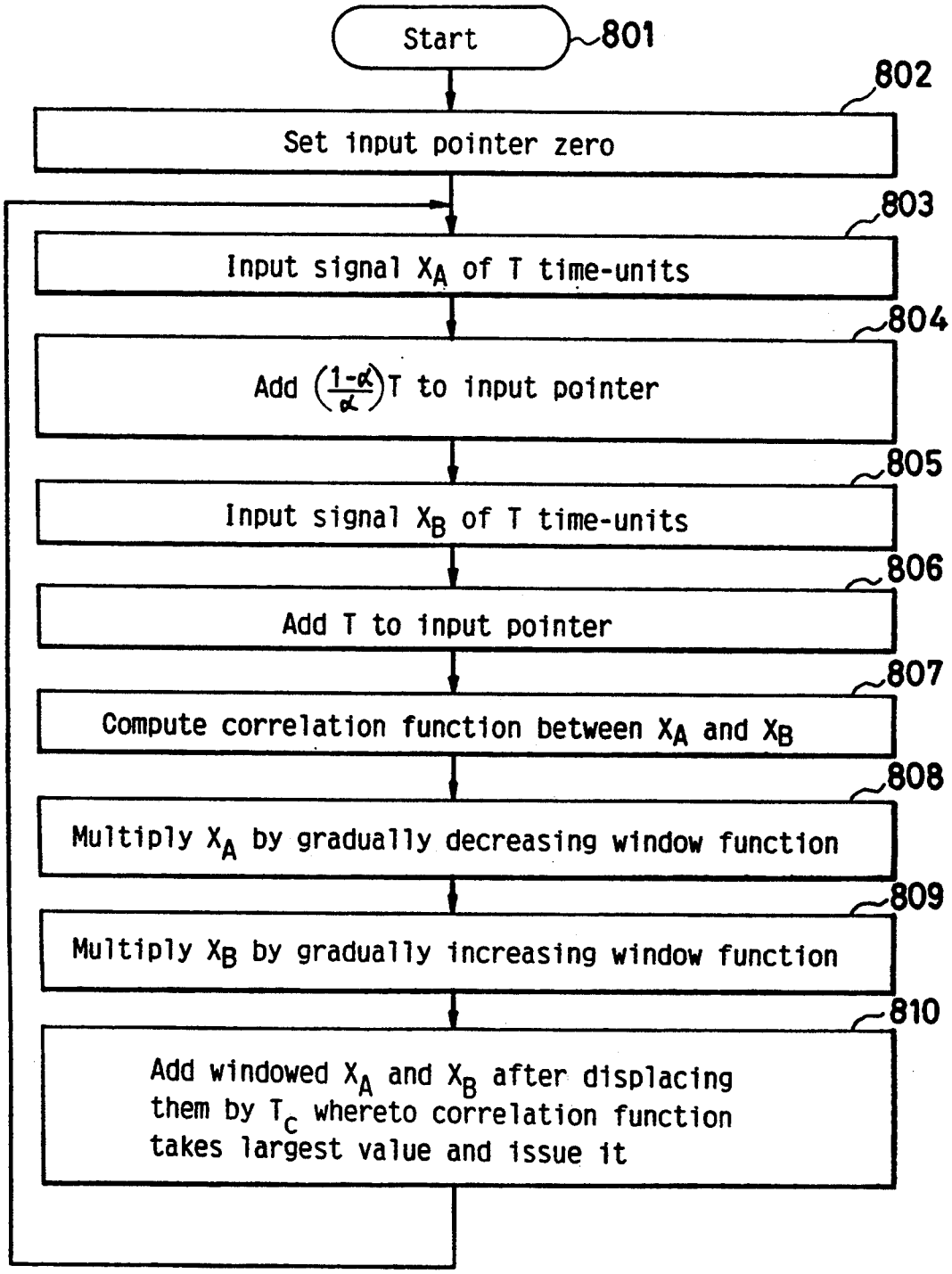
FIG. 8 is a flow chart representing a speech rate modification method in a third embodiment of the present invention.
Figure 9A:
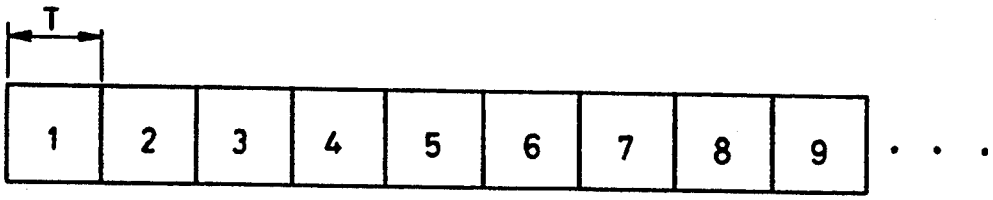
FIGS. 9(*a*)–9(*e*) show schematic diagram of processing voice waveforms in accordance with the speech rate modification method in the third embodiment of the present invention.
Figure 9A:
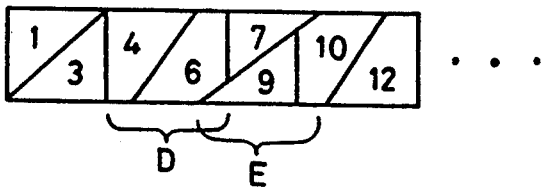
Figure 9A:
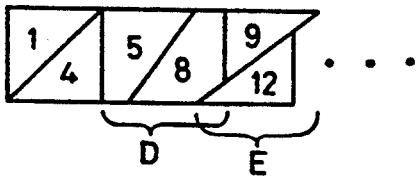
Figure 9D:
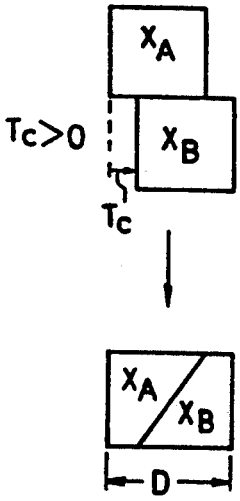
Figure 9E:
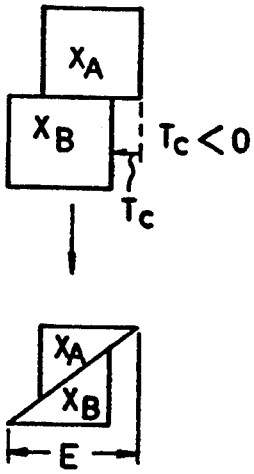

FIG. 8 shows a flow chart representing a speech rate modification method in the present embodiment, and the same hardware as shown in FIG. 1 is used. Its operation is elucidated below.

First, an input pointer is reset (step 802). Then, a signal $X_A$ having a time-length as long as T time-units starting from a time point designated by this input pointer is inputted (step 803). Then, $(1-\alpha)T/\alpha$ is added to the input pointer to update it (step 804). Next, a signal $X_B$ having the same time-length as long as T time-units starting from a time point designated by this updated input pointer is inputted (step 805). T is added to the input pointer to update (step 806). Then a correlation function between $X_A$ and $X_B$ is computed (step 807). Based on this correlation function thus obtained, $X_A$ is multiplied by a window of a gradually decreasing function (step 808). Also based on this correlation function obtained, $X_B$ is multiplied by a window of a gradually increasing function (step 809). Then based also on the correlation function obtained, these windowed signals $X_A$ and $X_B$ are added to each other after they are displaced at a point at which the correlation function between $X_A$ and $X_B$ takes a largest value within a time-length of unitary segment and the added result is issued (step 810). Then operation returns to step 803.

FIG. 9 schematically represents actual exemplary cases, wherein FIG. 9(*a*) schematically shows a succession of segments each having a time-length of T time-units of original voice signals on which speech rate modification process is to be carried out, FIGS. 9(*b*) and (*c*) schematically represent embodiments where the time-scale modification ratios $\alpha$ are $\frac{1}{3}$ and $\frac{1}{4}$, respectively, and FIGS. 9(*d*) and (*e*) schematically illustrate examples of individual detailed processes of the addition calculation; FIG. 9(*d*) illustrates a case of the addition calculation designated by D in FIG. 9(*b*) and FIG. 9(*c*), wherein the addition calculation is performed under the condition that the correlation function takes a largest value when $X_B$ is displaced to the positive side by $T_c$ time-units with respect to $X_A$. FIG. 9(*e*) illustrates another case of the addition calculation designated by E in FIG. 9(*b*) and FIG. 9(*c*), wherein the addition calculation is done for the same condition when $X_B$ is displaced to the negative side by $T_c$ time-units with respect to $X_A$. In the exemplary cases shown in FIGS. 9(*b*) and (*c*), there are time intervals designated by E which correspond to the time interval E of FIG. 9(*e*). In these time intervals, time sections extending outside the overlapping time interval may overlap also to adjacent time intervals and hence it is necessary to perform the amplitude adjustments also in those adjacent time intervals.

As has been described above, according to the present embodiment, signals $X_A$ and $X_B$ are multiplied respectively by window functions which are complementary to each other, one being a gradually increasing window function and the other being a gradually decreasing window function. A signal obtained by adding these windowed signals is issued, and this process is repeated. Thus, a speech voice having an ample naturalness with less discontinuities in signal amplitude can be issued for a range of the time-scale modification ratio of $\alpha \leqq 0.5$. By computing a correlation function between $X_A$ and $X_B$, and adding windowed signals $X_A$ and $X_B$ by displacing their mutual position so that the computed correlation function takes a largest value within a time-length of unitary segment, a high quality speech voice with less discontinuities in the signal phase can be issued. Moreover, by changing the time interval between $X_A$ and $X_B$, it becomes possible to easily change the time-scale modification ratio.

Figure 10:
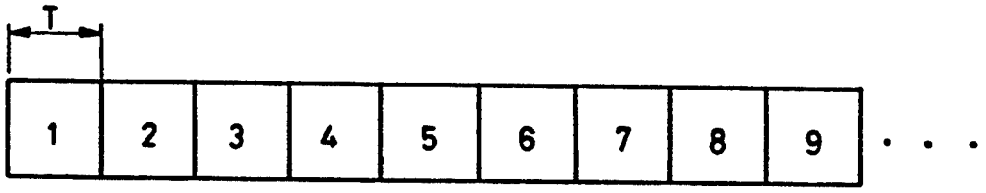
FIGS. 10(*a*)–10(*e*) show schematic diagram of processing voice waveforms in accordance with the speech rate modification method in the third embodiment of the present invention.
Figure 10:
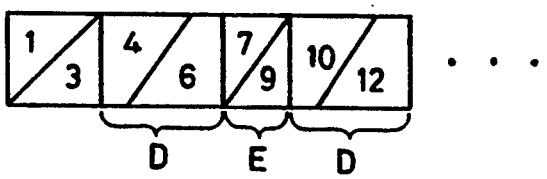
Figure 10:
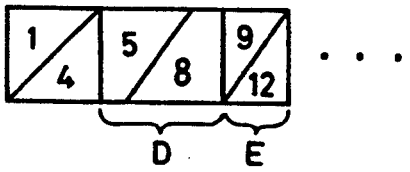
Figure 10:
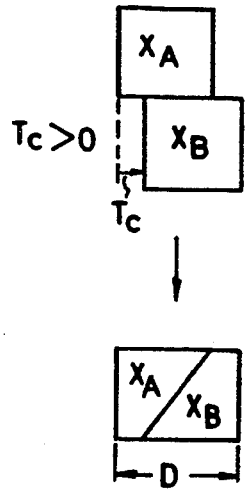
Figure 10:
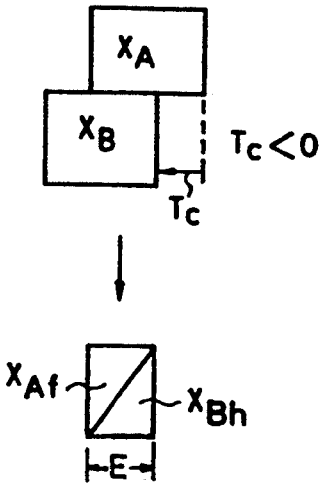

FIG. 10 schematically illustrates modified exemplary cases obtained by modifying the above-mentioned embodiment, wherein FIG. 10(*a*) schematically shows a succession of segments each having a time-length of T time-units of an original voice signal on which the speech rate modification process is to be carried out, FIGS. 10(*b*) and (*c*) schematically represent embodiments where the time-scale modification ratios $\alpha$ are $\frac{1}{3}$ and $\frac{1}{4}$, respectively, and FIGS. 10(*d*) and 10(*e*) schematically illustrate examples of detailed individual processes of the addition calculation. FIG. 10(*d*) illustrates a case of the addition calculation designated by D in FIG. 10(*b*) and FIG. 10(*c*), wherein the addition calculation is done under a condition that the correlation function takes a largest value when $X_B$ is displaced to the positive side by $T_c$ time-units with respect to $X_A$. FIG. 10(*e*) illustrates another case of the addition calculation designated by E in FIG. 10(*b*) and FIG. 10(*c*), wherein the addition calculation for the same condition is done when $X_B$ is displaced to the negative side by $T_c$ time-units with respect to $X_A$, and time sections extending outside the leading and rear edges of the overlapping time interval are discarded. In these exemplary cases shown in FIGS. 10(*b*) and (*c*), too, there are time intervals designated by E which correspond to the time interval E of FIG. 10(*e*). In these time intervals, time sections extending outside the overlapping time interval are discarded as shown in FIG. 10(*e*). This modified method can be realized by changing the window function. This modified method enables realizing a simplification of the process described above without suffering a degradation in the recognizability of the speech voice.

In the following, elucidation is given on the fourth embodiment of the speech rate modification method of the present invention referring to FIGS. 11 and 12.

The purpose of this embodiment is to offer a method of speech rate modification which is capable of giving a speech voice having an ample naturalness with less discontinuities in signal amplitude and phase and also with less data drop-offs also for a range of the time-scale modification ratio of $\alpha \leqq 0.5$.

Figure 11:
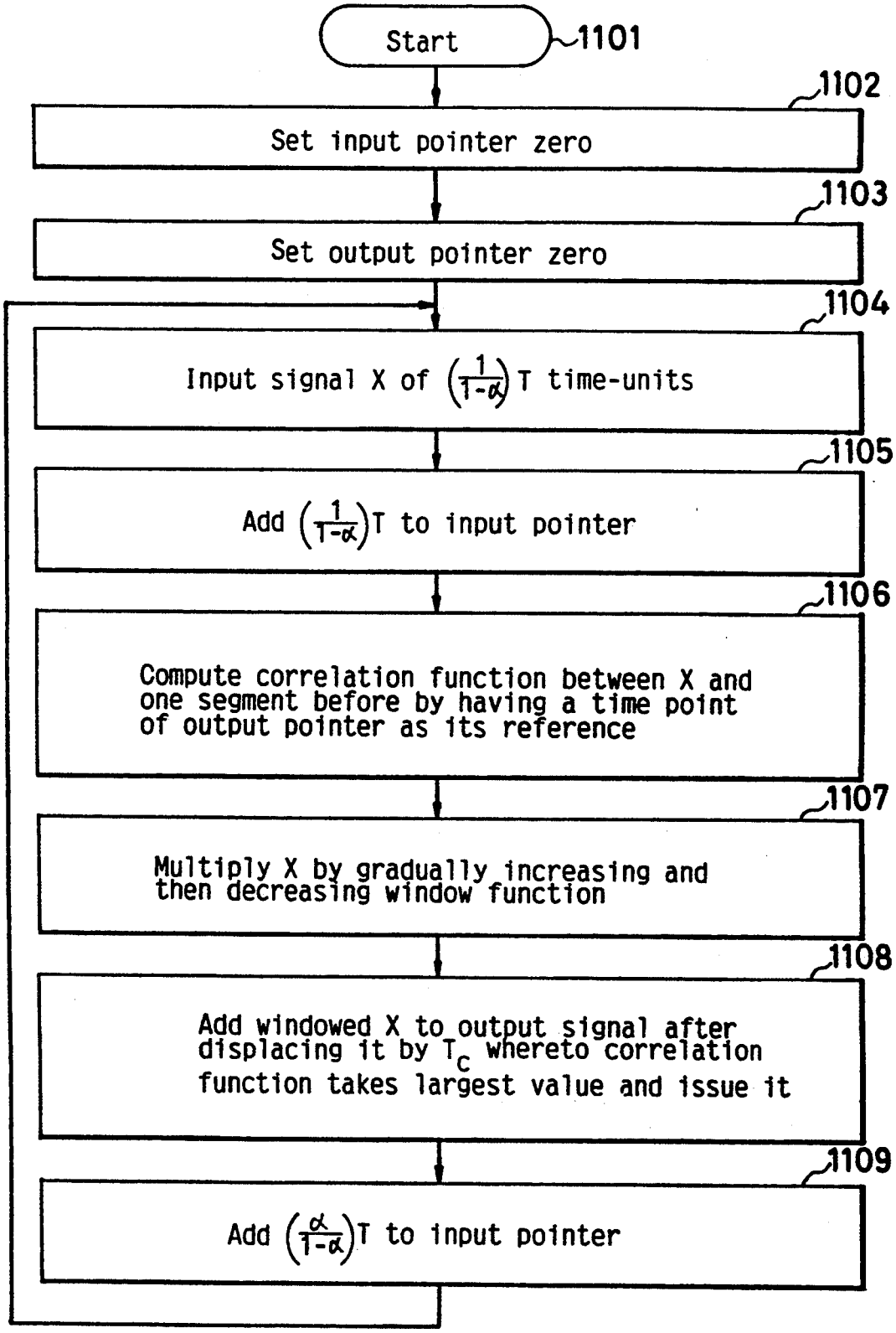
FIG. 11 is a flow chart representing a speech rate modification method in a fourth embodiment of the present invention.

FIG. 11 shows a flow chart representing a speech rate modification method in the present embodiment, and the same hardware as shown in FIG. 1 is used. Its operation is elucidated below.

First, an input pointer is reset (step 1102). Next, an output pointer is reset (step 1103). Then, a signal X having a time-length as long as $T/(1-\alpha)$ time-units starting from a time point designated by this input pointer is inputted (step 1104). The, $T/(1-\alpha)$ is added to the input pointer to update it (step 1105). Next, a correlation function between X and the output of the preceding segment is computed by having a time point of the output pointer as its reference (step 1106). Based on this correlation function thus obtained, X is multiplied by a window of a gradually increasing function at its leading-half part and a gradually decreasing function at its rear-half part (step 1107). Then based also on the correlation function obtained, this windowed X is added to the output signal so that the correlation function takes a largest value within a time-length of unitary segment and the added result is issued (step 1108). Then $\alpha T/(1-\alpha)$ is added to the output pointer to update it (step 1109). Next, operation returns to step 1104.

Figure 12A:
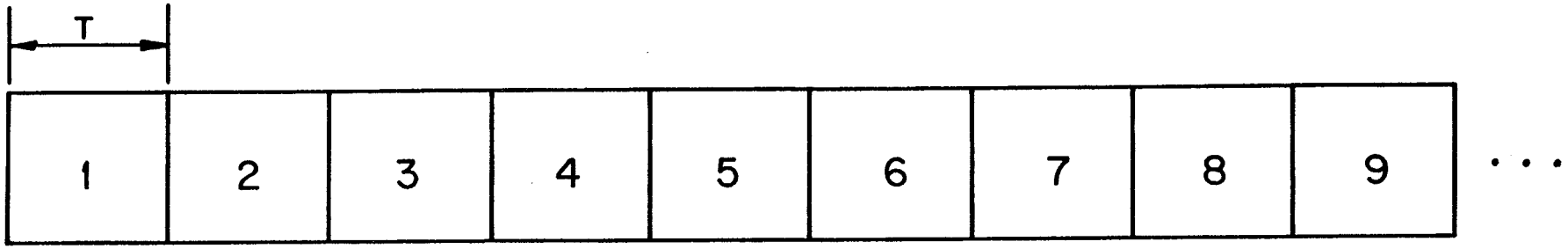
FIGS. 12(*a*)–12(*c*) show schematic diagram of processing voice waveforms in accordance with the speech rate modification method in the fourth embodiment of the present invention.
Figure 12B:
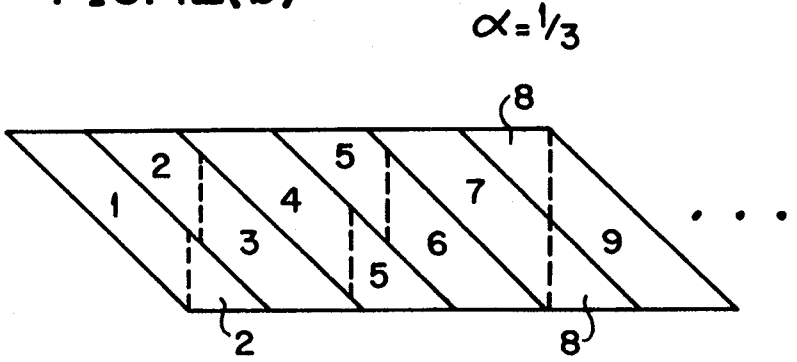
Figure 12C:
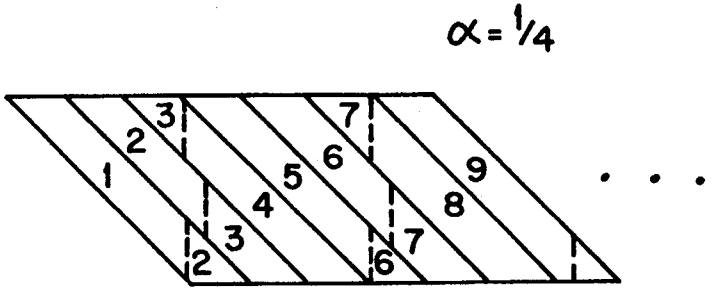

FIG. 12 schematically represents actual exemplary cases, wherein the time-scale modification ratios $\alpha$ are $\frac{1}{3}$ and $\frac{1}{4}$. As has been described above, according to the present embodiment, X is multiplied by a window function which increases gradually at its leading-half part and decreases gradually at its rear-half part on X. Then this windowed signal X is added to the output signal and issued, and this process is repeated. Thus, a speech voice having an ample naturalness with less discontinuities in signal amplitude and also with less data drop-offs can be issued for a time-scale modification ratio of $\alpha \leqq 0.5$. By computing a correlation function between X and a preceding segment, and adding them by displacing their mutual position so that their correlation function takes a largest value within a time-length of unitary segment, a high quality speech voice with less discontinuities in the signal phase can be issued. Moreover, by changing the amount of shifting between the input pointer and the output pointer, it becomes possible to easily change the time-scale modification ratio.

The purpose of the present invention is to offer a speech rate modification apparatus which is capable of giving a speech voice having an ample naturalness with less discontinuities in signal amplitude and phase and also with less data drop-offs and also which can be realized with a simple hardware.

In the following, elucidation is given on the second or improved apparatus-embodiment of a speech rate modification of the present invention referring to FIGS. 13 through 15. The apparatus is improved to achieve an intended accurate time scale of the rate-modified speech, and is applicable to the foregoing 1st through 4th method embodiments.

Figure 13:
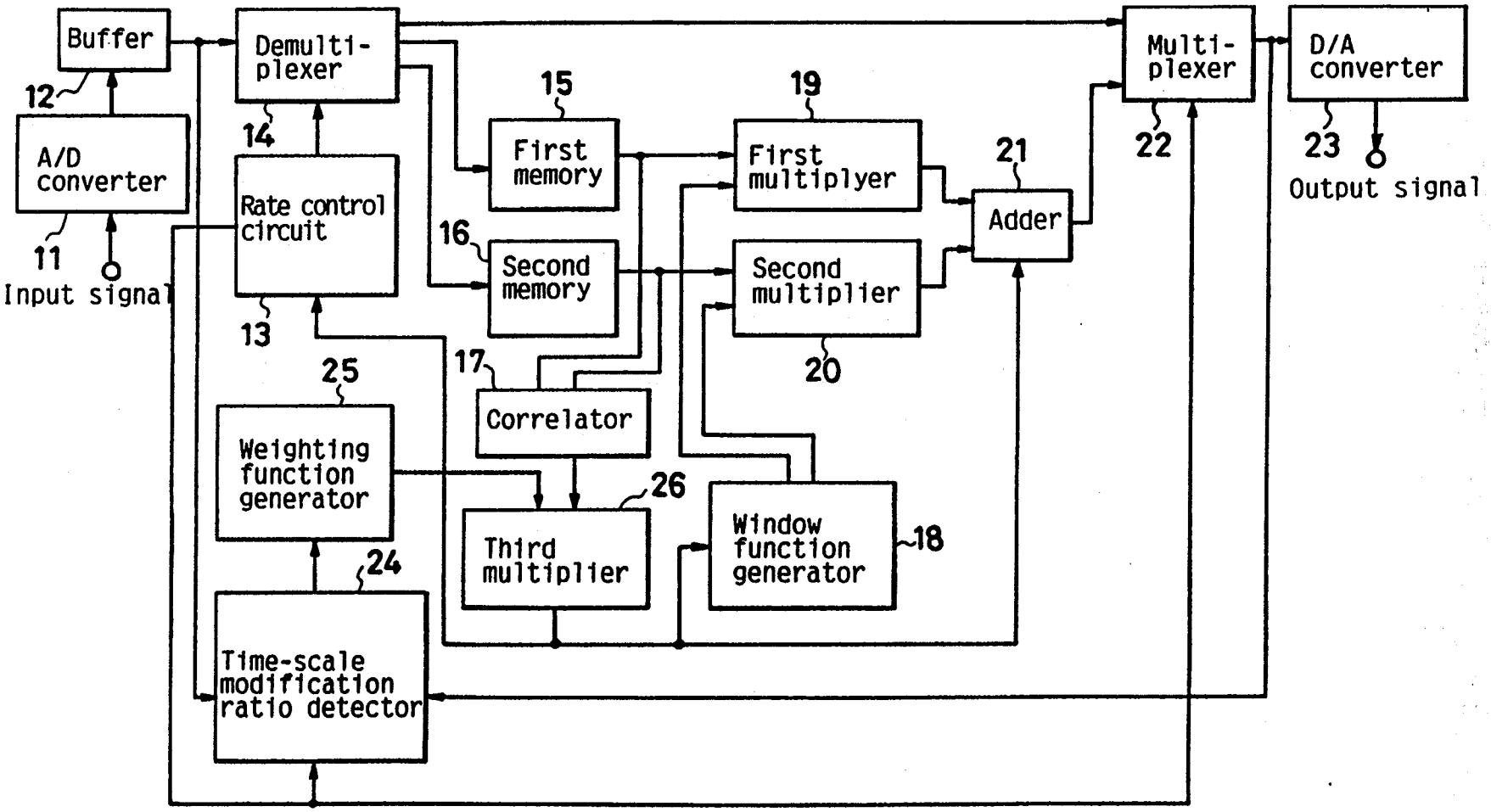
FIG. 13 is a block diagram of an improved embodiment of speech rate modification apparatus of the present invention.

FIG. 13 is a block diagram of the improved speech rate modification apparatus in the present embodiment. In FIG. 13, numeral 11 is an A/D converter for converting an input voice signal to a digitized voice signal. A buffer 12 is for temporarily storing the digitized voice signal. A demultiplexer 14 switches to deliver the digitized voice signal to a first memory 15, to a second memory 16, and to a multiplexer 22, and is controlled by a rate control circuit 13. A correlator 17 is for computing a correlation function between outputs of the first memory 15 and the second memory 16. Output terminals of the correlator 17 are connected to a third multiplier 26, which multiplies the output of a weighting function generator 25 on the output of the correlator 17. The weighting function generator 25 generates weighting functions depending upon the output of a time-scale modification ratio detector 24, which detects the difference between the number of data supplied to the demultiplexer 14 and the number of data issued from the multiplexer 22 under the control of the rate control circuit 13. The output of the third multiplier 26 is supplied to the rate control circuit 13, the window function generator 18, and an adder 21. A first multiplier 19 and a second multiplier 20 are for multiplying the output of the window function generator 18 by outputs of the first memory 15 and of the second memory 16, respectively. The output terminals of the multipliers 19 and 20 are connected to the adder 21 which adds outputs to each other and is controlled by the output of the third multiplier 26. The multiplexer 22 is for combining outputs from the adder 21 and the demultiplexer 14 under control of the rate control circuit 13. Then a D/A converter 23 is for converting the combined digital signal to an analog output signal.

While the speech rate modification apparatus constituted has been described above, its operation is elucidated below.

First, the input signal is converted into a digital signal by the A/D converter 11 and written into the buffer 12. Next, the rate control circuit 13 controls the demultiplexer 14 in accordance with a given time-scale modification ratio to supply the data in the buffer 12 to the first memory 15 and the second memory 16, and also to the multiplexer 22. The time-scale modification ratio detector 24 detects a time-scale modification ratio presently being processed by judging from the number of data supplied to the demultiplexer 14 and the number of data issued from the multiplexer 22. Monitoring the deviation from the target time-scale modification ratio which is set in the rate control circuit 13, information thus obtained is issued to the weighting function generator 25. Next, the weighting function generator 25 corrects the weighting function to be issued in a manner such that the time-scale modification ratio of speech voice data presently being processed does not deviate largely corresponding to an amount of the deviation with respect to the target time-scale modification ratio obtained from the time-scale modification ratio detector 24. Then, a correlation function between the contents of the first memory 15 and that of the second memory 16 is computed by the correlator 17. The third multiplier 26 performs a multiplication calculation between the output of the correlator 17 and the output of the weighting function generator 25. Then the information thus obtained is supplied to the rate control circuit 13, the window function generator 18, and the adder 21. The window function generator 18 supplies a window function to the first multiplier 19 and the second multiplier 20 based on the information from the third multiplier 26. Then the first multiplier 19 performs a multiplication calculation between the contents of the first memory 15 and the first window function issued from the window function generator 18, whereas the second multiplier 20 performs a multiplication calculation between the contents of the second memory 16 and the second window function issued also from the window function generator 18. The adder 21 performs an addition calculation between the output of the first multiplier 19 and the output of the second multiplier 20 after displacing their mutual position so that the weighted correlation function takes a largest value within a time-length of unitary segment based on the information from the third multiplier 26 and supplies its output to the multiplexer 22. Then the multiplexer 22 selects the output of the adder 21 and the output of the multiplexer 14 and supplies the selected result to the D/A converter 23, which converts the resultant digital signal to an analog signal.

Figure 15A:
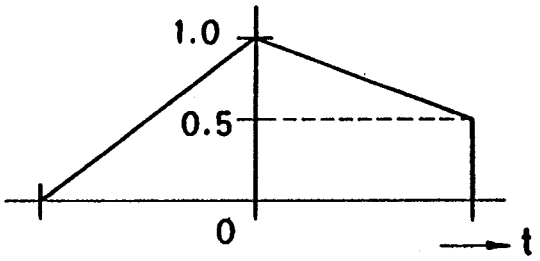
FIGS. 15(*a*)–15(*c*) are schematic diagram representing weighting functions for the correlation values in accordance with the speech rate modification apparatus in the second embodiment of the present invention.
Figure 15B:
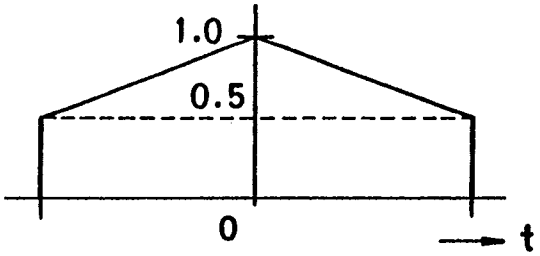
Figure 15C:
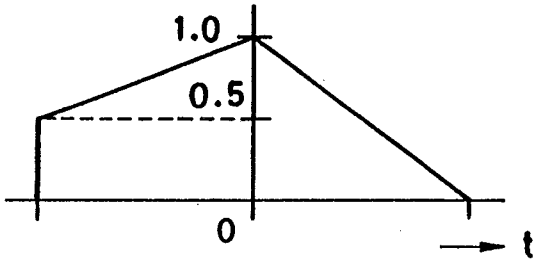
Figure 14A:
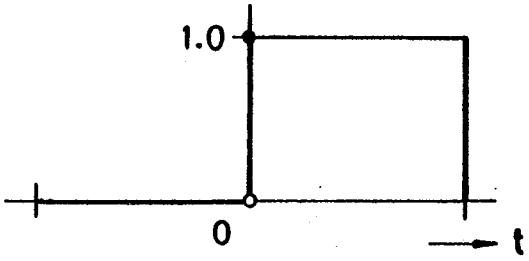
FIGS. 14(*a*)–14(*c*) are schematic diagram representing weighting functions to be applied to the correlation values in accordance with the speech rate modification apparatus in the second embodiment of the present invention.
Figure 14B:
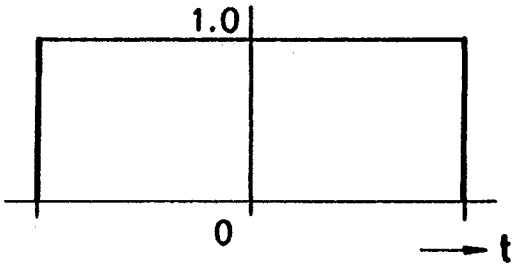
Figure 14C:
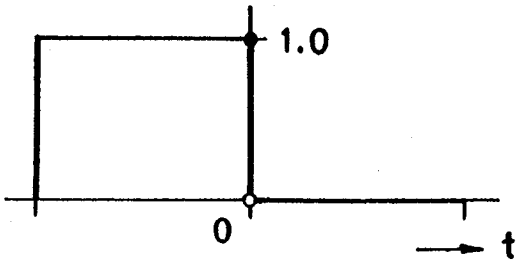

FIG. 14 and FIG. 15 show examples of weighting functions issued from the weighting function generator 25.

In these figures, each abscissa represents a mutual delay between two segments whereon the correlation function is computed.

FIG. 14 shows a weighting function by which the largest value of the correlation function is searched only at a side wherein the deviation is made less. FIG. 14(*a*) shows a case where the deviation from the target time-scale modification ratio increases when the largest value of the correlation function is present on the negative side. FIG. 14(*b*) shows a case where the presently processed time-scale modification ratio does not deviate from the target time-scale modification ratio. Finally, FIG. 14(*c*) shows a case where the deviation from the target time-scale modification ratio increases when the largest value of the correlation function is present at the positive side.

FIG. 15 shows a weighting function which searches, in case that the presently processed time-scale modification ratio deviates from the target time-scale modification ratio, the largest value of the correlation function by putting weight on the side on which the deviation is made less. FIG. 15(*a*) shows a case where the deviation from the target time-scale modification ratio increases when the largest value of the correlation function is present on the negative side. FIG. 15(*b*) shows a case where the presently processed time-scale modification ratio does not deviate from the target time-scale modification ratio. And, FIG. 15(*c*) shows a case where the deviation from the target time-scale modification ratio increases when the largest value of the correlation function is present on the positive side.

As has been described above, according to the present embodiment, similarly to the first apparatus embodiment of FIG. 1, by using the first multiplier 19 and the second multiplier 20, the contents of the first memory 15 and the contents of the second memory 16 are multiplied respectively by a window function generated from the window function generator 18. Then those windowed outputs from respective multipliers are added to each other by the adder 21. Thus, a speech voice having an ample naturalness with less discontinuities in the signal amplitude and also with less data drop-offs can be obtained. In this embodiment, the correlator 17 computes a correlation function between the contents of the first memory 15 and the contents of the second memory 16. The adder 21 performs an addition calculation between the outputs from the first multiplier 19 and from the second multiplier 20 after displacing their mutual positions so that the correlation function between the output of the first multiplier 19 and the output of the second multiplier 20 takes a largest value within a time-length of unitary segment. Thus, the discontinuities in the phase of the signal thereby are reduced.

When the addition calculations are performed successively at those parts at which the correlation function takes a largest value within a time-length of unitary segment, the time-scale modification ratio actually obtained may deviate from the target time-scale modification ratio. Then, according to the configuration of FIG. 13, the time-scale modification ratio actually being processed is detected by the time-scale modification ratio detector 24, and thereby the deviation from the target value is monitored. Responding to the deviation, the weighting function generator 25 changes the weighting function and issues it. Thus, the deviation from the target time-scale modification ratio can easily be reduced and and also a time position at which the correlation function takes a largest value within a time-length of unitary segment can be found. Thereby a high quality processed speech voice with fewer time scale fluctuations can be obtained with a desired time-scale modification ratio.

In the following, elucidation is given on the fifth embodiment of the speech rate modification method of the present invention referring to FIGS. 16 through 18.

The present embodiment is to offer a method of speech rate modification which is capable of giving a speech voice having an ample naturalness with less discontinuities in signal amplitude and phase and also with less data drop-offs for a time-scale modification ratio of $\alpha \geqq 1.0$.

Figure 16:
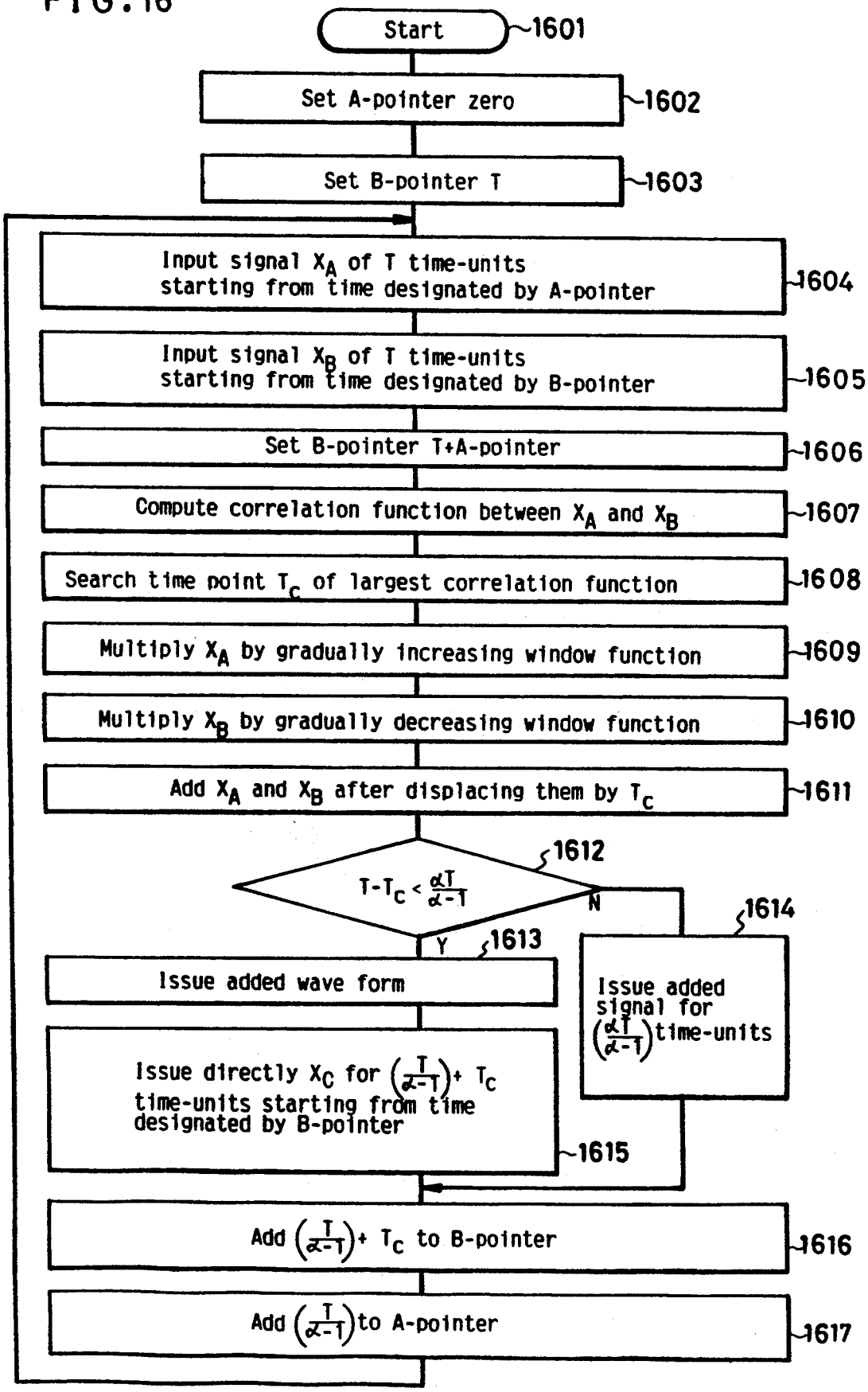
FIG. 16 is a flow chart representing a speech rate modification method in a fifth embodiment of the present invention.
Figure 17A:
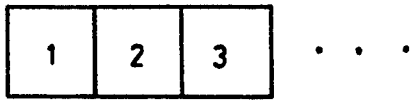
FIGS. 17(*a*)–17(*e*) show schematic diagram of processing voice waveforms in accordance with the speech rate modification method in the fifth embodiment of the present invention.
Figure 17A:
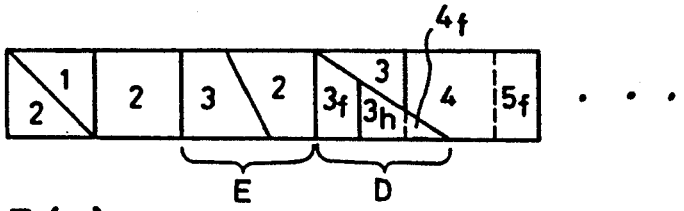
Figure 17A:
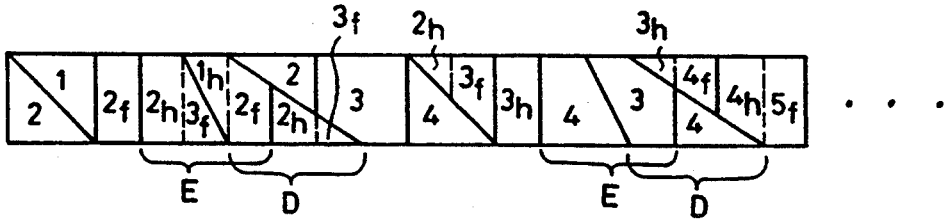
Figure 17D:
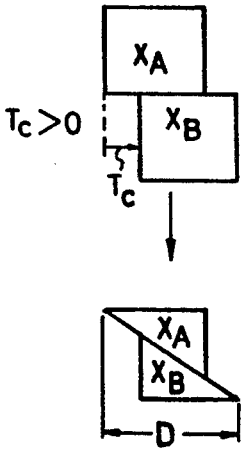
Figure 17E:
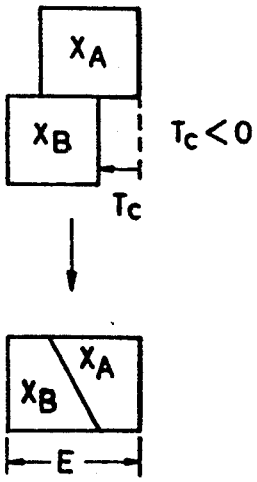

FIG. 16 shows a flow chart representing a speech rate modification method in the present embodiment. Its operation is elucidated below.

First, an A-pointer is set to be 0 (step 1602), while a B-pointer is set to be T (step 1603). Then, a signal $X_A$ having a time-length as long as T time-units starting from a time point designated by the A-pointer is inputted (step 1604), and a signal $X_B$ having a time interval as long as T time-units starting from a time point designated by the B-pointer is inputted (step 1605). Then, the B-pointer is updated by inputting a number obtained by adding T on the contents of the A-pointer (step 1606). Then a correlation function between $X_A$ and $X_B$ is computed (step 1607). A time point $T_c$ (which corresponds to a time point displaced by $T_c$ from the time point when two segments completely overlap) at which the correlation function takes its largest value within a time-length of one unitary segment is searched (step 1608). Based on this correlation function thus obtained, $X_A$ is multiplied by a window of a gradually increasing function (step 1609). Also based on this correlation function obtained, $X_B$ is multiplied by a window of a gradually decreasing function (step 1610). Then based also on the correlation function obtained, these windowed signals $X_A$ and $X_B$ are added to each other after they are mutually displaced at a time point at which the correlation function takes a largest value within one unitary segment (step 1611). Next, in case that $T-T_c$ is less than $\alpha T/(\alpha-1)$, an added signal is all issued (step 1613), further a signal $X_C$ of a time-length as long as $T/(\alpha-1)+T_c$ time-units starting from a time point designated by the B-pointer is directly issued (step 1615). On the other hand, in case that $\alpha T/(\alpha-1)$ is less than $T-T_c$, the added signal is issued only for a time-length of $\alpha T/(\alpha-1)$ time-units (step 1614). Next, $T/(\alpha-1)+T_c$ is added to the B-pointer to update it (step 1616), and $T/(\alpha-1)$ is added to the A-pointer to update it (step 1617). Then, operation returns to step 1604.

FIG. 17 schematically represents actual exemplary cases, wherein FIG. 17(*a*) schematically shows a succession of segments having a time-length of T time-units of original voice signals on which the speech rate modification process is to be carried out, FIG. 17(*b*) and FIG. 17(*c*) schematically represent embodiments where the time-scale modification ratios $\alpha$ are 2.0 and 3.0, respectively, and FIG. 17(*d*) and FIG. 17(*e*) schematically illustrate examples of individual detailed process of the mutual addition calculation. FIG. 17(*d*) illustrates a case of the addition calculation designated by D in FIG. 17(*b*) and FIG. 17(*c*). wherein the addition calculation is performed under the condition that the correlation function takes a largest value when $X_B$ is displaced to the positive side by $T_c$ time-units with respect to $X_A$, whereas FIG. 17(*e*) illustrates another case of the addition calculation designated by E in FIG. 17(*b*) and FIG. 17(*c*), wherein the addition calculation is done for the same condition when $X_B$ is displaced to the negative side by $T_c$ time-units with respect to $X_A$. In the exemplary cases shown in FIG. 17(*b*) and FIG. 17(*c*), there are time intervals designated by D which correspond to the time interval D of FIG. 17(*d*). In these time intervals, time sections extending outside the overlapping time interval may overlap also to adjacent time intervals and hence it is necessary to perform the amplitude adjustments also in those adjacent time intervals.

As has been described above, according to the present embodiment, signals $X_A$ and $X_B$ are multiplied respectively by window functions which are complementary to each other, one being a gradually increasing window function and the other being a gradually decreasing window function. A signal obtained by adding these windowed signals is issued, and a signal $X_C$ subsequent to $X_A$ is issued, and these processes are repeated. Thus, a speech voice having an ample naturalness with less discontinuities in signal amplitude and also with less data drop-offs can be issued for a range of the time-scale modification ratio of $\alpha \geqq 1.0$. By computing a correlation function between $X_A$ and $X_B$ and adding windowed signals $X_A$ and $X_B$ by displacing their mutual position so that the correlation function obtained takes a largest value within a time-length of one unitary segment, a high quality speech voice with less discontinuities in the signal phase can be issued. Moreover, by adjusting the segment length of $X_C$ in which the input signal is directly issued, it becomes possible to easily change the time-scale modification ratio. Also, according to the above-mentioned method, it becomes possible to rapidly absorb such deviations in the time-scale modification ratio that might be caused by the addition calculation performed by displacing the mutual position of those windowed signals to make the correlation function take a largest value within a time-length of one unitary segment.

Figure 18:
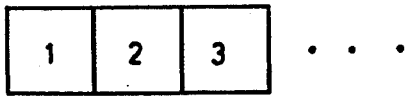
FIGS. 18(*a*)–18(*e*) show a schematic diagram of processing voice waveforms in accordance with the speech rate modification method in the fifth embodiment of the present invention.
Figure 18:
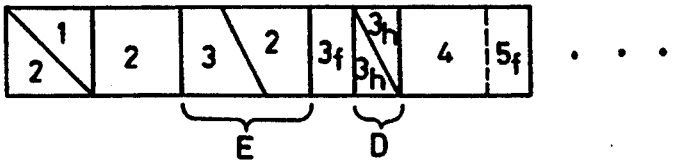
Figure 18:
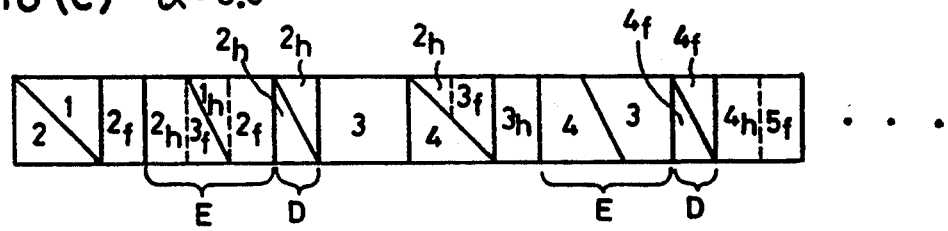
Figure 18:
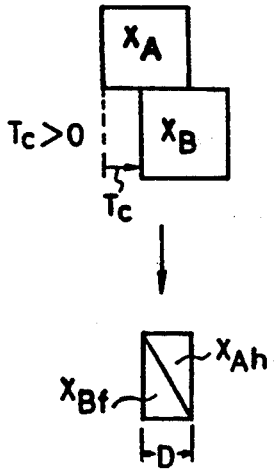
Figure 18:
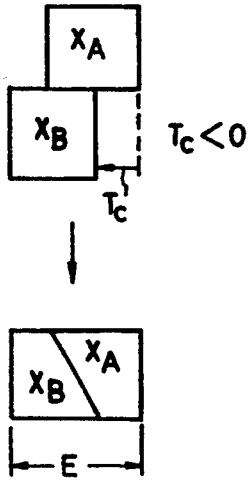

FIG. 18 schematically illustrates modified exemplary cases obtained by modifying the above-mentioned embodiment, wherein FIG. 18(*a*) schematically shows a succession of segments each having a time-length of T time-units of an original voice signal on which the speech rate modification process is to be carried out, FIG. 18(*b*) and FIG. 18(*c*) schematically represent embodiments where the the time-scale modification ratios $\alpha$ are 2.0 and 3.0, respectively, and FIGS. 18(*d*) and (*e*) schematically illustrate examples of detailed individual process of the addition calculation. FIG. 18(*d*) illustrates a case of the addition calculation designated by D in FIG. 18(*b*) and FIG. 18(*c*), wherein the addition calculation is done under a condition that the correlation function takes a largest value when $X_B$ is displaced to the positive side by $T_c$ time-units with respect to $X_A$ and time sections extending outside the leading and rear edges of the overlapping time interval are discarded. FIG. 18(*e*) illustrates another case of the addition calculation designated by E in FIG. 18(*b*) and FIG. 18(*c*), wherein the addition calculation for the same condition is done when $X_B$ is displaced to the negative side by $T_c$ time-units with respect to $X_A$. In these exemplary cases shown in FIG. 18(*b*) and FIG. 18(*c*), too, there are time intervals designated by D which correspond to the time interval D of FIG. 18(*d*). In these time intervals, time sections extending outside the overlapping time interval are discarded as shown in FIG. 18(*d*). This modified method can be realized by changing the window function. This modified method enables realizing a simplification of the process described above without suffering a degradation in the recognizability of the speech voice.

In the following, elucidation is given on the sixth embodiment of the speech rate modification method of the present invention referring to FIGS. 19 through 21.

The purpose of the present embodiment is to offer a method of speech rate modification which is capable of giving a speech voice having an ample naturalness with less discontinuities in signal amplitude and phase and also with less data drop-offs also for a range of the time-scale modification ratio of $0.5 \leqq \alpha \leqq 1.0$.

Figure 19:
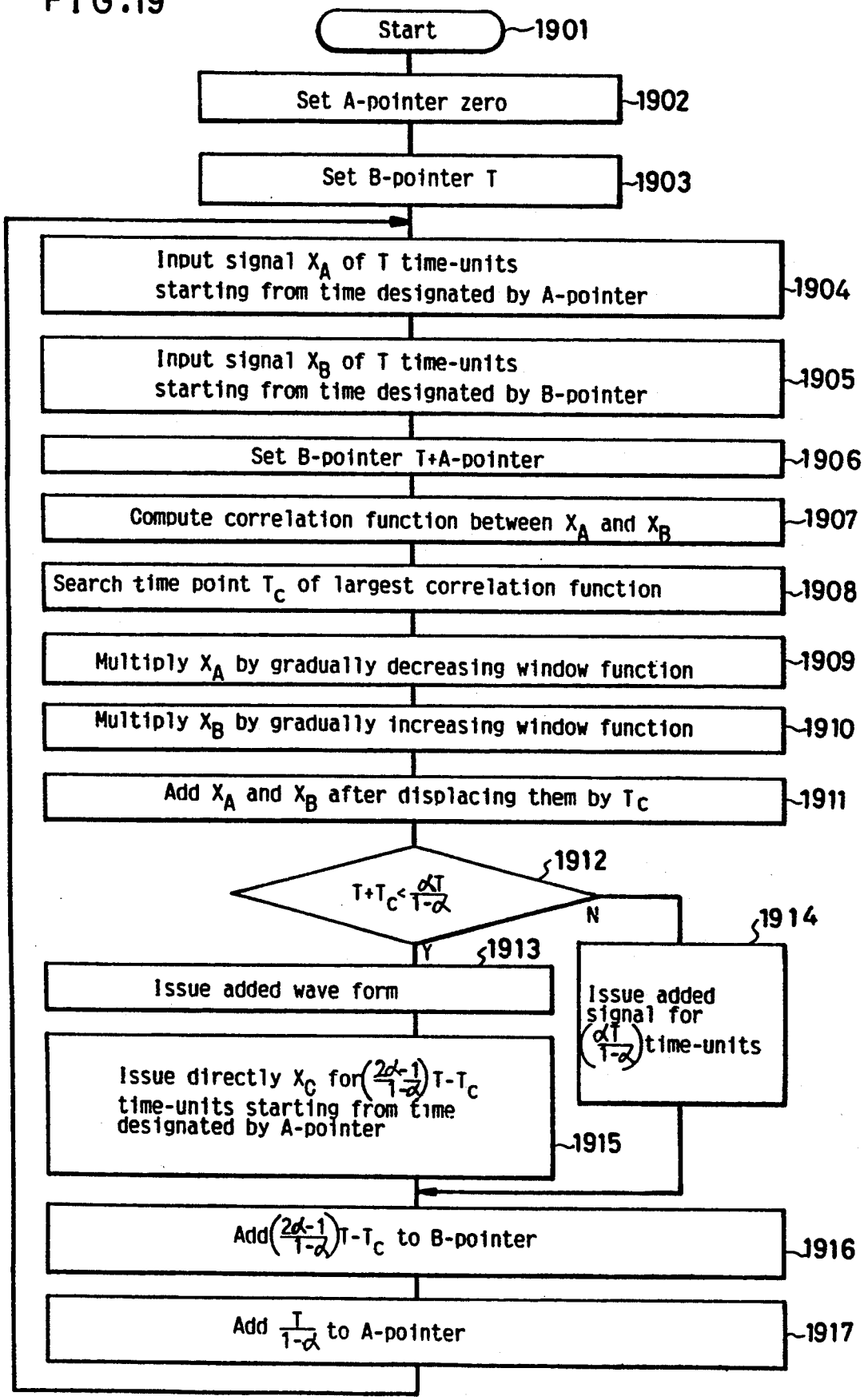
FIG. 19 is a flow chart representing a speech rate modification method in a sixth embodiment of the present invention.
Figure 20A:
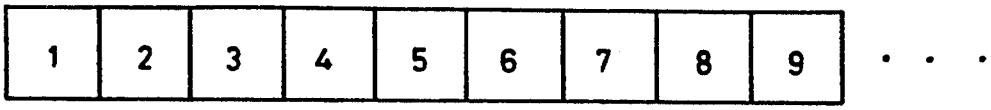
FIGS. 20(*a*)–20(*e*) show a schematic diagram of processing voice waveforms in accordance with the speech rate modification method in the sixth embodiment of the present invention.
Figure 20A:
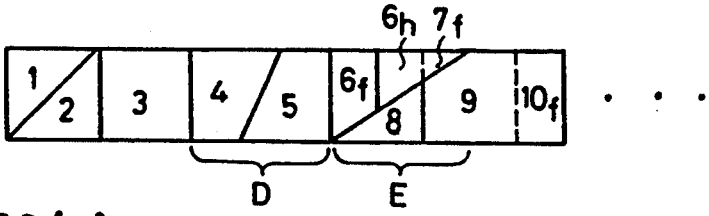
Figure 20A:
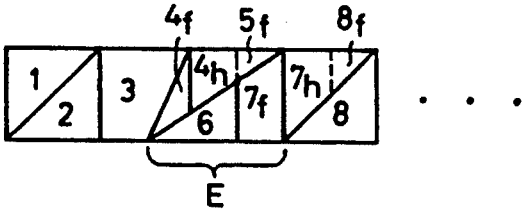
Figure 20D:
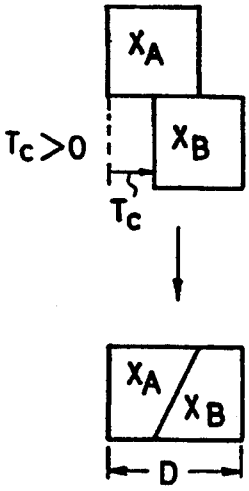
Figure 20E:
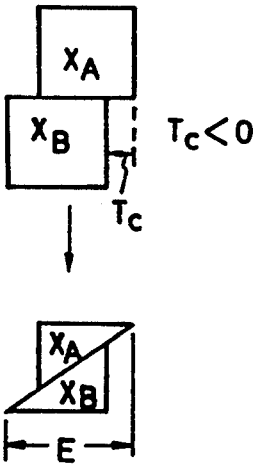
Figure 21A:
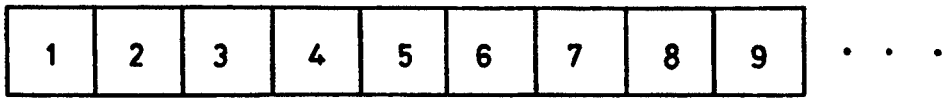
FIGS. 21(*a*)–21(*e*) show schematic diagram of processing voice waveforms in accordance with the speech rate modification method in the sixth embodiment of the present invention.
Figure 21A:
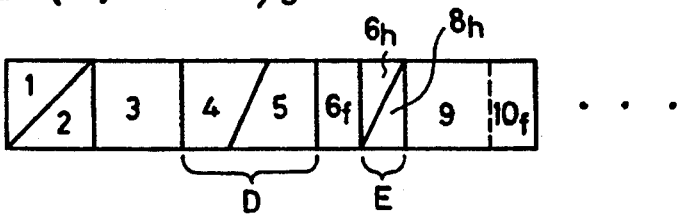
Figure 21A:
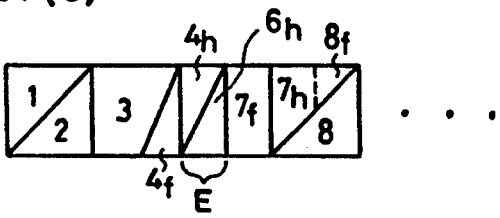
Figure 21D:
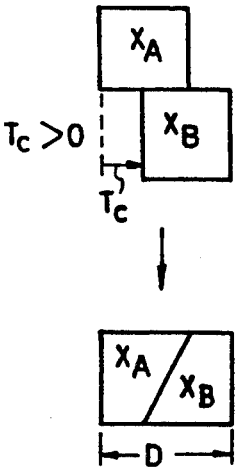
Figure 21E:
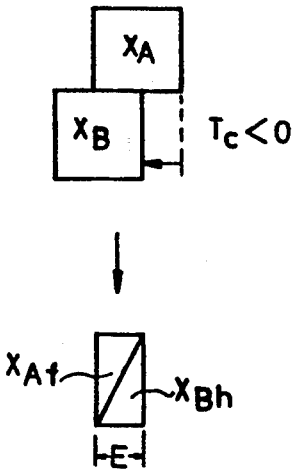

FIG. 19 shows a flow chart representing a speech rate modification method in the present embodiment, and the same hardware as shown in FIG. 1 is used. Its operation is elucidated below.

First, an A-pointer is set to be 0 (step 1902), while a B-pointer is set to be T (step 1903). Then, a signal $X_A$ having a time-length as long as T time-units starting from a time point designated by the A-pointer is inputted (step 1904). A signal $X_B$ having a time interval as long as T time-units starting from a time point designated by the B-pointer is inputted (step 1905). Then, the A-pointer is updated to be a number obtained by adding T on the contents of the B-pointer (step 1906). Then a correlation function between $X_A$ and $X_B$ is computed (step 1907). A time point $T_c$ at which the correlation function takes its largest value in a time-length of one unitary segment is searched (step 1908). Based on this correlation function thus obtained, $X_A$ is multiplied by a window of a gradually decreasing function (step 1909). Also based on this correlation function obtained, $X_B$ is a window of a gradually increasing function (step 1910). Then based also on the correlation function obtained, these windowed signals $X_A$ and $X_B$ are added to each other after they are mutually displaced at a time point at which the correlation function takes a largest value within a time-length of one unitary segment (step 1911). Next, in case that $T+T_c$ is less than $\alpha T/(1-\alpha)$, an added signal is all issued (step 1913). Further a signal $X_C$ of a time interval as long as $(2\alpha-1)T/(1-\alpha)-T_c$ time-units starting from a time point designated by the A-pointer is directly issued (step 1915). On the other hand, in case that $\alpha T/(1-\alpha)$ is less than $T+T_c$, the added signal is issued only for a time-length of $\alpha T/(1-\alpha)$ time-units (step 1914). Next, $(2\alpha-1)T/(1-\alpha)-T_c$ is added to the A-pointer to update it (step 1916), and $T/(1-\alpha)$ is added to the B-pointer to update it (step 1917). Then, operation returns to the step 1904.

FIG. 20 schematically represents actual exemplary cases, wherein FIG. 20(*a*) schematically shows a succession of segments each having a time-length of T time-units of original voice signals on which speech rate modification process is to be carried out, FIG. 20(*b*) and FIG. 20(*c*) schematically represent embodiments where the time-scale modification ratios $\alpha$ are $\frac{2}{3}$ and 0.5, respectively, and FIG. 20(*d*) and FIG. 20(*e*) schematically illustrate examples of individual detailed process of the mutual addition calculation. FIG. 20(*d*) illustrates a case of the addition calculation, designated by D in FIG. 20(*b*) and FIG. 20(*c*), wherein the addition calculation is performed under the condition that the correlation function takes a largest value when $X_B$ is displaced to the positive side by $T_c$ time-units with respect to $X_A$. FIG. 20(*e*) illustrates another case of the addition calculation designated by E in FIG. 20(*b*) and FIG. 20(*c*), wherein the addition calculation is done for the same condition when $X_B$ is displaced to the negative side by $T_c$ time-units with respect to $X_A$. In the exemplary cases shown in FIG. 20(*b*) and FIG. 20(*c*), there are time intervals designated by E which correspond to the time interval E of FIG. 20(*e*). In these time intervals, time sections extending outside the overlapping time interval may overlap also to adjacent time intervals and hence it is necessary to perform the amplitude adjustments also in those adjacent time intervals.

As has been described above, according to the present embodiment, signals $X_A$ and $X_B$ are multiplied respectively by window functions which are complementary to each other, one being a gradually increasing window function and the other being a gradually decreasing window function. A signal obtained by adding these windowed signals is issued, and a signal $X_C$ subsequent to $X_B$ is issued, and these process is repeated. Thus, a speech voice having an ample naturalness with less discontinuities in signal amplitude and also with less data drop-offs can be issued for a range of the time-scale modification ratio of $0.5 \leqq \alpha \leqq 1.0$. By computing a correlation function between $X_A$ and $X_B$, and adding windowed signals $X_A$ and $X_B$ by displacing their mutual position so that the correlation function obtained takes a largest value within a time-length of one unitary segment, a high quality speech voice with less discontinuities in the signal phase can be issued. Moreover, by adjusting the segment length of $X_C$ in which the input signal is directly issued, it becomes possible to easily change the time-scale modification ratio. Also, according to the above-mentioned method, it becomes possible to rapidly absorb such deviations in the time-scale modification ratio that might be caused by the addition calculation performed by displacing the mutual position of those windowed signals to make the correlation function take a largest value within a time-length of one unitary segment.

FIG. 21 schematically illustrates modified exemplary cases obtained by modifying the above-mentioned embodiment, wherein FIG. 21(*a*) schematically shows a succession of segments each having a time-length of T time-units of an original voice signal on which the speech rate modification process is to be carried out, FIG. 21(*b*) and FIG. 21(*c*) schematically represent embodiments where the time-scale modification ratios $\alpha$ are $\frac{2}{3}$ and 0.5, respectively, and FIG. 21(*d*) and FIG. 21(*e*) schematically illustrate examples of detailed individual processes of the addition calculation. FIG. 21(*d*) illustrates a case of the addition calculation designated by D in FIG. 21(*b*) and FIG. 21(*c*), wherein the addition calculation is done under a condition that the correlation function takes a largest value when $X_B$ is displaced to the positive side by $T_c$ time-units with respect to $X_A$. FIG. 21(*e*) illustrates another case of the addition calculation, designated by E in FIG. 21(*b*) and FIG. 21(*c*), wherein the addition calculation for the same condition is done when $X_B$ is displaced to the negative side by $T_c$ time-units with respect to $X_A$ and time sections extending outside the leading and rear edges of the overlapping time interval are discarded. In these exemplary cases shown in FIG. 21(*b*) and FIG. 21(*c*), too, there are time intervals designated by E which correspond to the time interval E of FIG. 21(*e*). In these time intervals, time sections extending outside the overlapping time interval are discarded as shown in FIG. 21(*e*). This modified method can be realized by changing the window function. This modified method enables realizing a simplification of process described above without suffering a degradation in the recognizability of the speech voice.

In the following, elucidation is given on the seventh embodiment of the speech rate modification method of the present invention referring to FIGS. 22 through 24.

The purpose of this embodiment is to offer a method of speech rate modification which is capable of giving a speech voice having an ample naturalness with less discontinuities in signal amplitude and phase for a time-scale modification ratio of $\alpha \leqq 0.5$.

Figure 22:
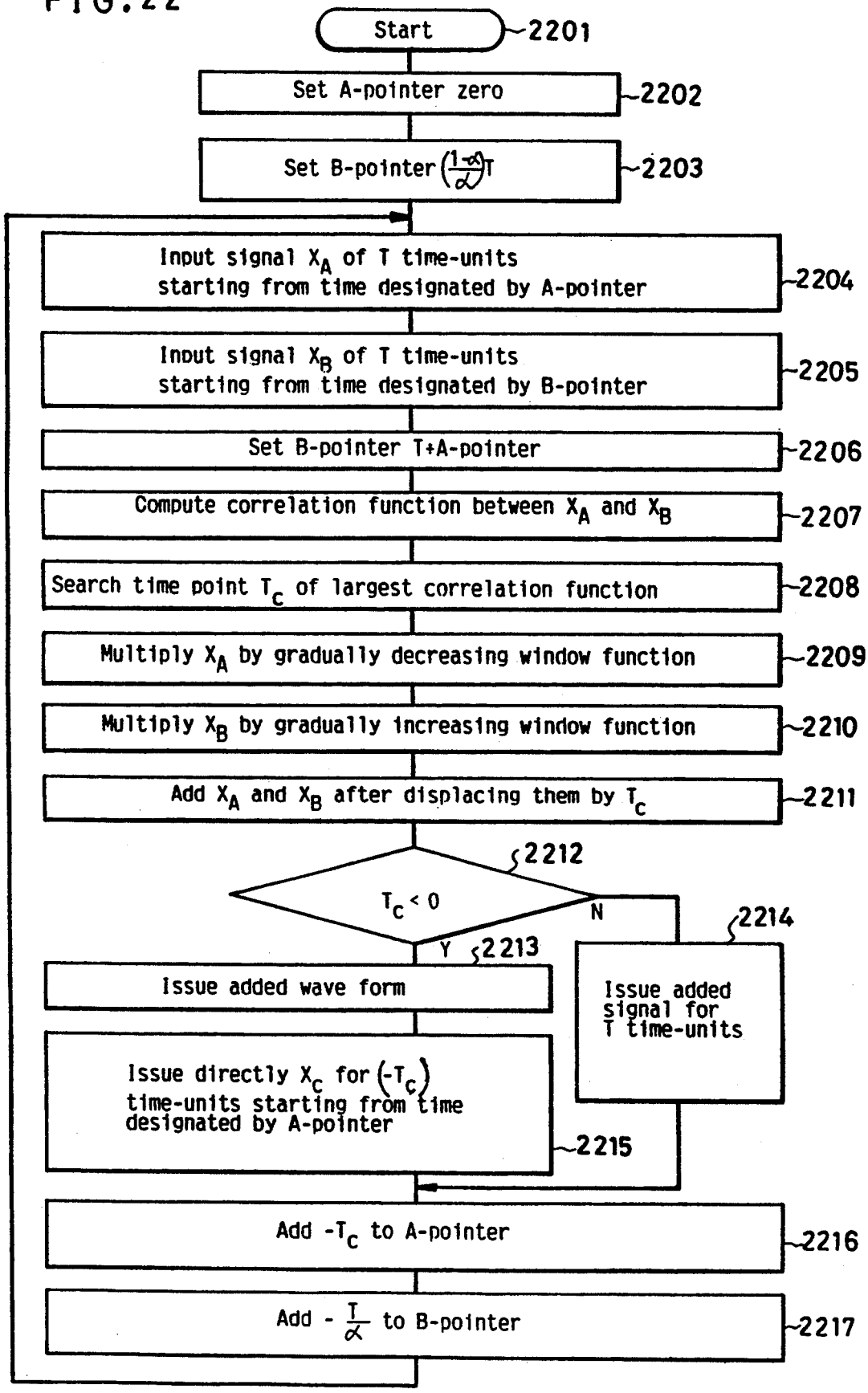
FIG. 22 is a flow chart representing a speech rate modification method in a seventh embodiment of the present invention.
Figure 23A:
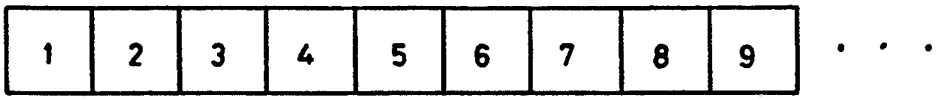
FIGS. 23(*a*)–23(*e*) show schematic diagram of processing voice waveforms in accordance with the speech rate modification method in the seventh embodiment of the present invention.
Figure 23A:
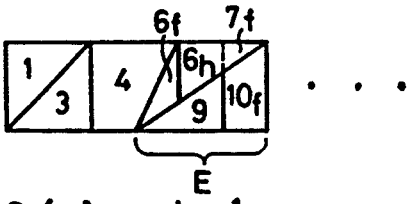
Figure 23A:
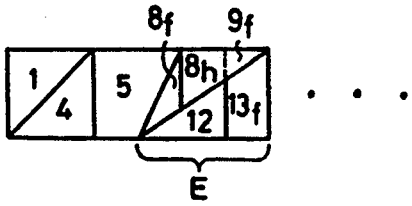
Figure 23D:
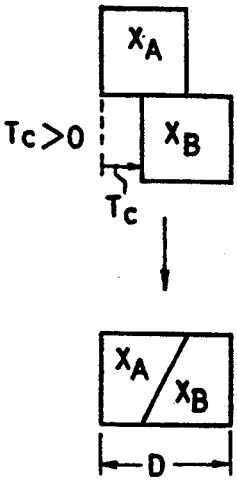
Figure 23E:
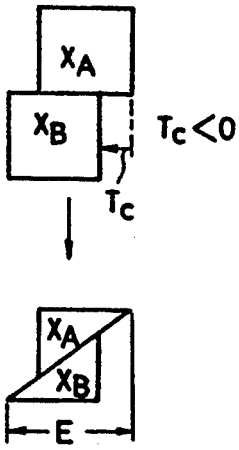
Figure 24A:
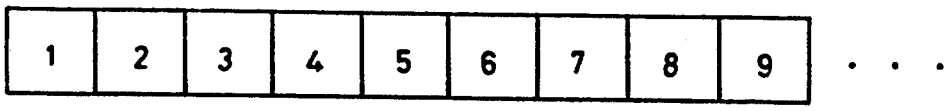
FIGS. 24(*a*)–24(*e*) shows schematic diagram of processing voice waveforms in accordance with the speech rate modification method in the seventh embodiment of the present invention.
Figure 24A:
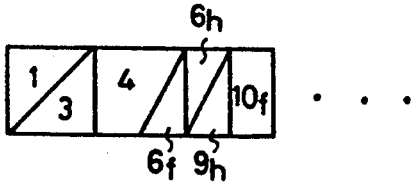
Figure 24A:
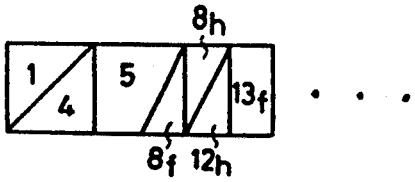
Figure 24D:
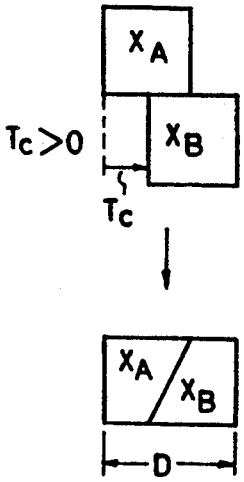
Figure 24E:
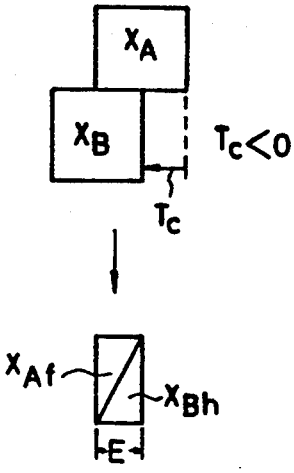

FIG. 22 shows a flow chart representing a speech rate modification method in the present embodiment, and the same hardware as shown in FIG. 1 is used. Its operation is elucidated below.

First, an A-pointer is set to be 0 (step 2202), while a B-pointer is set to be $(1-\alpha)T/\alpha$ (step 2203). Then, a signal $X_A$ having a time interval as long as T segments starting from a time point designated by the A-pointer is inputted (step 2204). A signal $X_B$ having a time interval as long as T segments starting from a time point designated by the B-pointer is inputted (step 2205). Then, the A-pointer is updated to be a number obtained by adding T on the contents of the B-pointer (step 2206). Then a correlation function between $X_A$ and $X_B$ is computed (step 2207). A time point $T_c$ at which the correlation function takes its largest value is searched (step 2208). Based on this correlation function thus obtained, $X_A$ is multiplied by a window of a gradually decreasing function (step 2209). Also based on this correlation function obtained, $X_B$ is multiplied by a window of a gradually increasing function. (step 2210). Then, based also on the correlation function obtained, these windowed $X_A$ and $X_B$ are added to each other after they are mutually displaced at a time point at which the correlation function takes a largest value within a time-length of one unitary segment (step 2211). Next, in case that $T_c$ is negative, an added signal is all issued (step 2213). Further a signal $X_C$ of a time interval as long as $-T_c$ time-units starting from a time point designated by the A-pointer is issued (step 2215). On the other hand, in case that $T_c$ is not negative, the added signal is issued only for a time interval of T time-units (step 2214). Next, $-T_c$ is added to the A-pointer to update it (step 2216). And $T/\alpha$ is added to the B-pointer (step 2217). Then operation returns to the step 2204.

FIG. 23 schematically represents actual exemplary cases, wherein FIG. 23(*a*) schematically shows a succession of segments each having a time-length of T time-units of original voice signals on which speech rate modification process is to be carried out, FIG. 23(*b*) and FIG. 23(*c*) schematically represent embodiments where the time-scale modification ratios $\alpha$ are $\frac{1}{3}$ and $\frac{1}{4}$, respectively. FIG. 23(*d*) and FIG. 23(*e*) schematically illustrate examples of individual detailed process of the mutual addition calculation. FIG. 23(*d*) illustrates a case of the addition calculation designated by D in FIG. 23(*b*) and FIG. 23(*c*), wherein the addition calculation is performed under the condition that the correlation function takes a largest value when $X_B$ is displaced to the positive side by $T_c$ time-units with respect to $X_A$. FIG. 23(*e*) illustrates another case of the addition calculation, designated by E in FIG. 23(*b*) and FIG. 23(*c*), wherein the addition calculation is done for the same condition when $X_B$ is displaced to the negative side by $T_c$ time-units with respect to $X_A$. In the exemplary cases shown in FIGS. 23(*b*) and (*c*), there are time intervals designated by E which correspond to the time interval E of FIG. 23(*e*). In these time intervals, time sections extending outside the overlapping time interval may overlap also to adjacent time intervals and hence it is necessary to perform the amplitude adjustments also in those adjacent time intervals.

As has been described above, in accordance with the present embodiment, signals $X_A$ and $X_B$ are multiplied respectively by window functions which are complementary to each other, one being a gradually increasing window function and the other being a gradually decreasing window function. A signal obtained by adding these windowed signals is issued, a signal $X_C$ subsequent to $X_B$ is issued, and this process is repeated. Thus, a speech voice having an ample naturalness with less discontinuities in signal amplitude can be issued for a range of the time-scale modification ratio of $\alpha \leqq 0.5$. By computing a correlation function between these windowed $X_A$ and $X_B$, and adding windowed $X_A$ and $X_B$ by displacing their mutual position so that the computed correlation function takes a largest value within a time-length of one unitary segment, a high quality speech voice with less discontinuities in the signal phase can be obtained. Moreover, by adjusting the position of the B-pointer with respect to the A-pointer, it becomes possible to easily change the time-scale modification ratio. Also, according to the above-mentioned method, it becomes possible to rapidly absorb such deviations in the time-scale modification ratio that might be caused by the addition calculation performed by displacing the mutual position of those windowed signals to make the correlation function take a largest value within a time-length of one unitary segment.

FIG. 24 schematically illustrates modified exemplary cases obtained by modifying the above-mentioned embodiment, wherein FIG. 24(*a*) schematically shows a succession of segments each having a time-length of T time-units of an original voice signal on which the speech rate modification process is to be carried out, FIG. 24(*b*) and FIG. 24(*c*) schematically represent embodiments where the the time-scale modification ratios $\alpha$ are $\frac{1}{3}$ and $\frac{1}{4}$, respectively, and FIG. 24(*d*) and FIG. 24(*e*) schematically illustrate examples of detailed individual processes of the addition calculation. FIG. 24(*d*) illustrates a case of the addition calculation designated by D in FIG. 24(*b*) and FIG. 24(*c*), wherein the addition calculation is done under a condition that the correlation function takes a largest value when $X_B$ is displaced to the positive side by $T_c$ time-units with respect to $X_A$. FIG. 24(*e*) illustrates another case of the addition calculation, designated by E in FIG. 24(*b*) and FIG. 24(*c*), wherein the addition calculation for the same condition is done when $X_B$ is displaced to the negative side by $T_c$ time-units with respect to $X_A$ and time sections extending outside the leading and rear edges of the overlapping time interval are discarded. In these exemplary cases shown in FIG. 24(*b*) and FIG. 24(*c*), too, there are time intervals designated by E which correspond to the time interval E of FIG. 24(*e*). In these time intervals, time sections extending outside the overlapping time interval are discarded as shown in FIG. 24(*e*). This modified method can be realized by changing the window function. This modified method enables realizing a simplification of the process described above without suffering a degradation in the recognizability of the speech voice.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. Method for modifying speech rate and changing a speech reproduction time interval by 1.0 times or more comprising the following steps:

deriving a correlation function in a range being shorter than a time length T with respect to a positive direction in which said second signal is moved to a direction with respect to said first signal and a negative direction in which said second signal is moved to an inverse direction of said direction with respect to said first signal from a reference time point at which a starting point of said first signal is in coincidence with a starting point of said second signal, in said first signal of the time length T and said second signal of the time length T, and deriving a time point $T_c$ at which a value of said correlation function becomes a maximum value, displacing said first signal with respect to said second signal at a time point at which the correlation function takes a largest value within a time-length of one unitary segment of speech to be analyzed, multiplying said first signal by a first window function whose amplitude determined on the basis of a time point at which a value of the correlation function is maximum increases gradually to obtain a windowed first signal, multiplying said second signal by a second window function whose amplitude determined on the basis of a time point at which a value of the correlation function is maximum decreases gradually to obtain a windowed second signal, adding said first signal multiplied by said first window function and said second signal multiplied by said second window function to each other and outputting them, issuing a third signal of a time-length of $\{T/(\alpha-1)\}$ time-units subsequent to the first signal wherein $\alpha$ is a time-scale modification ratio defined as output time duration/input time duration, setting a starting point for said first signal at a next process to be a point at which the starting point of said first signal is delayed by a time interval of $\{T/(\alpha-1)\}$ time-units, and repeating all the above-mentioned steps.

2. Method for modifying speech rate for changing speech reproduction time interval of a range of from 0.5 times to 1.0 times comprising the following steps:

computing a correlation function between a first signal and a second signal subsequent to the first signal and deriving a time point at which a value of the correlation function is maximum, displacing said second signal with respect to said first signal at a time point at which the correlation function takes a largest value, multiplying said first signal by a first window function whose amplitude determined on the basis of a time point at which a value of the correlation function is maximum decreases gradually to obtain a windowed first signal, multiplying said second signal by a second window function whose amplitude decided on the basis of a time point at which a value of the correlation function is maximum increases gradually to obtain a windowed second signal, adding said first signal multiplied by said first window function and said second signal multiplied by said second window function to each other to issue an added result, issuing a third signal subsequent to said second signal, said third signal being an original input signal for a time interval decided on the basis of a time-scale modification ratio, setting a starting point of a first signal in a next process to be a subsequent time point of a terminal time point of said third signal, and repeating all the above-mentioned steps.

3. Method for modifying speech rate for changing speech reproduction time interval of a range of from 0.5 times to 1.0 times comprising the following steps:

deriving a correlation function in a range shorter than a time length T with respect to a positive direction in which said second signal is moved to a direction with respect to said first signal and a negative direction in which said second signal is moved to an inverse direction of said direction with respect to said first signal from a reference time point at which a starting point of said first signal is in coincidence with a starting point of said second signal, in said first signal of the time length T and said second signal of the time length T, and deriving a time point $T_c$ at which a value of said correlation function becomes a maximum value, displacing said second signal with respect to said first signal at a time point at which the correlation function takes a largest value, multiplying said first signal by a first window function whose amplitude decided on the basis of a time point at which a value of the correlation function is maximum decreases gradually to obtain a windowed first signal, multiplying said second signal by a second window function whose amplitude decided on the basis of a time point at which a value of the correlation function is maximum increases gradually to obtain a windowed second signal, adding said first signal multiplied by said first window function and said second signal multiplied by said second window function to issue an added result, issuing a third signal of a time-length of $\{(2\alpha-1)T/(1-\alpha)\}$ time-units subsequent to the second signal decided on the basis of a time-scale modification ratio, setting a starting point of said first signal at a next process to be a next point to a terminal point of said third signal, and repeating all the above-mentioned steps.

4. Method for modifying speech rate for changing speech reproduction time interval by 0.5 or less comprising the following steps:

setting a starting point of a second signal to a time point at which a first signal is delayed by such a time interval as to make a desired time-scale modification ratio $\alpha$ defined at a ratio of output time duration/input time duration, computing a correlation function between said first signal and said second signal and deriving a time point at which the value of the correlation function is maximum, displacing said second signal with respect to said first signal to a time point at which said correlation function takes a largest value, multiplying said first signal by a first window function whose amplitude determined on the basis of a time point at which a value of the correlation function is maximum decreases gradually to obtain a windowed first signal, multiplying said second signal by a second window function whose amplitude decided on the basis of a time point at which a value of the correlation function is maximum increases gradually to obtain a windowed second signal, adding first signal multiplied by said window function and said second signal multiplied by said second window function to each other to issue an added result, setting a starting point of a first signal at a next process to be a point next to a terminal point of said second signal, and repeating all the above-mentioned steps.

5. Method for modifying speech rate for changing speech reproduction time interval by 0.5 or less comprising the following steps: setting a starting point of a second signal to a time point at which a starting point of a first signal is delayed by a time interval of $\{(1-\alpha)T/\alpha\}$ time-units wherein T is a time-length of one unitary segment and $\alpha$ is a time-scale modification ratio, deriving a correlation function in a range shorter than a time length T with respect to a positive direction in which said second signal is moved to a direction with respect to said first signal and a negative direction in which said second signal is moved to an inverse direction of said direction with respect to said first signal from a reference time point at which a starting point of said first signal is in coincidence with a starting point of said second signal, in said first signal of the time length T and said second signal of the time length T, and deriving a time point $T_c$ at which a value of said correlation function becomes a maximum value, displacing said second signal with respect to said first signal to said time point $T_c$ at which the correlation function takes a largest value within a time-length of one unitary segment, multiplying said first signal by a first window function whose amplitude determined on the basis of a time point at which a value of the correlation function is maximum decreases gradually to obtain a windowed first signal, multiplying said second signal by a second window function whose amplitude determined on the basis of a time point at which a value of the correlation function is maximum increases gradually to obtain a windowed second signal, adding said first signal multiplied by said first window function and said second signal multiplied by said second window function to each other to issue an added result, setting a starting point of a first signal at a next process to be a point at which a second signal is delayed by a time interval of T time-units; and repeating all the above-mentioned steps.

6. Method for modifying speech rate for changing speech reproduction time interval by 0.5 times or less comprising the following steps:

displacing an input signal with respect to a preceding output signal on the basis of time-scale modification ratio $\alpha$ defined as a ratio of output time duration/input time duration, computing a correlation function between said preceding output signal and said input signal and deriving a time point at which a value of the correlation function is maximum, displacing said input signal further to a time point at which the correlation function takes a largest value, multiplying said input signal by a window function whose amplitude decided on the basis of a time point at which a value of the correlation function is maximum increases gradually at its front-half part and a gradually decreases at its rear-half part, adding said input signal multiplied by said window function to said output signal to issue an added result, setting a starting point of an input signal in a next process to be a subsequent time point of a terminal time point of said input signal, and repeating all the above-mentioned steps as necessary.

7. Method for modifying speech rate for changing speech reproduction time interval by 0.5 times or less comprising the following steps:

displacing an input signal of a time length of $\{T/(1-\alpha)\}$ time-units to a point at which a starting point of a preceding output signal is displaced by a time interval of $\{\alpha T/(1-\alpha)\}$ time-units, computing a correlation function between said preceding signal and said input signal and deriving a time point at which a value of the correlation function is maximum, displacing said input signal to a time point at which said correlation function takes a largest value, multiplying said input signal by a window function whose amplitude decided on the basis of a value of a time-scale modification ratio $\alpha$ and a time point at which a value of the correlation function is maximum increases gradually at its front-half part and a gradually decreases at its rear-half part, adding said input signal multiplied by said window function to said output signal, setting a starting point of said input signal at a next process to be a point at which the starting point of said input signal is delayed by a time interval of $\{T/(1-\alpha)\}$ time-units, and repeating all the above-mentioned steps.

8. A speech rate modification apparatus comprising:

a correlator for computing a correlation function between signals, a time-scale modification ratio deviation detector for detecting a deviation of an actual time-scale modification ratio from a target time-scale modification ratio, a weighting function generator for generating a weighting function based upon an output of said time-scale modification ratio detector, a multiplier for multiplying an output of said correlator by an output of said weighting function generator, a maximum value detector for deriving a time point at which an output of said multiplier is maximum, and an adder for performing an addition calculation of said signals at a time point at which a weighted correlation function takes a largest value on the basis of an output of said maximum value detector.

9. A speech rate modification apparatus comprising:

a first memory for memorizing an input signal at a first time, a second memory for memorizing said input signal at a second time subsequent to said first time, a correlator for computing a correlation function between contents of said first memory and contents of said second memory, a time-scale modification ratio detector for detecting a deviation of an output of an actual time-scale modification ratio from a target time-scale modification ratio $\alpha$ defined as a ratio of output time duration/input time duration, a weighting function generator for generating weighting functions based upon an output of said time-scale modification ratio detector, a third multiplier for multiplying an output of said correlator by an output of said weighting function generator, a maximum value detector for deriving a time point at which an output of said third multiplier is maximum, a window function generator for generating two complementary window functions based on an output of said maximum value detector, a first multiplier for multiplying said contents of said first memory by a first output of said window function generator, a second multiplier for multiplying said contents of said second memory by a second output of said window function generator, an adder for performing a windowed addition calculation of an output of said first multiplier and an output of said second multiplier at a time point at which said correlation function takes a largest value based on an output of said maximum value detector, and a multiplexer responsive to a signal representative of the time-scale modification ratio, said multiplexer having as a first input the input signal, as a second input an output of said adder, and as its output a modified speech signal.

10. A speech rate modification apparatus in accordance with claim 9, wherein:

said weighting function generator issues said weighting function on the basis of said deviation between a target time-scale modification ratio $\alpha$ defined as a ratio of output time duration/input time duration and an actually resulting time-scale modification ratio issued from said time-scale modification ratio detector, and includes means for determining if an actually resulting time-scale modification ratio is longer than the target time-scale modification ratio $\alpha$, and means for selecting a largest value of the correlation function at a time point at which a time-length of a time-part of the output of the adder where the windowed addition calculation is performed is made shorter, and for selecting the largest value of the correlation function at a time point at which a time-length of a time-part of the output of the adder where the windowed addition calculation is performed is made longer.

11. A speech rate modification apparatus comprising:

a first memory for memorizing an input signal, a second memory for memorizing said input signal, a correlator for computing a correlation function between contents of said first memory and contents of said second memory and outputting a time point $T_c$ at which the correlation function is maximum, a window function generator for generating two complementary window functions based on an output of said correlator, a first multiplier for multiplying said contents of said first memory by a first output of said window function generator, a second multiplier for multiplying said contents of said second memory by a second output of said window function generator, an adder for performing an addition calculation between an output of said first multiplier and an output of said second multiplier at the time point $T_c$ at which said correlator function takes a largest value within a time-length of one unitary segment based on the output of said first multiplier, and a multiplexer responsive to a signal representative of a time point $T_c$ at which the correlation function is maximum and a value of a time-scale modification ratio $\alpha$ defined as a ratio of output time duration/input time duration, said multiplexer having as a first input said input signal, as a second input the output of said adder, and as its output a modified speech signal.

12. Method for modifying speech rate comprising the following steps:

computing a correlation function between a first signal and a second signal and deriving a time point $T_c$ at which a value of the correlation function is maximum, displacing said second signal with respect to said first signal to a time point at which the correlation function takes a largest value, multiplying said first signal and second signal respectively by first and second complementary window functions decided on the basis of the time-point $T_c$ at which a value of said correlation function is maximum, adding said first signal multiplied by said first complementary window function and said second signal multiplied by said second complementary window function to each other to issue an added result, issuing a third signal subsequent to said added result for a time interval decided on the basis of a time-scale modification ratio $\alpha$ and the time point $T_c$ at which a value of the correlation function is maximum to produce a desired time-scale modification ratio, and repeating all the above-mentioned steps.

13. Method for modifying speech rate and changing speech reproduction time interval by 1.0 times or more comprising the following steps:

computing a correlation function between a first signal and a second signal and deriving a time point $T_c$ at which a value of the correlation function is maximum, displacing said first signal with respect to said second signal at a time point $T_c$ at which said correlation function takes a largest value within a time-length of one unitary segment, multiplying said first signal by a first window function whose amplitude decided on the basis of the time point $T_c$ at which a value of said correlation function is maximum increases gradually to produce a windowed first signal, multiplying said second signal by a second window function whose amplitude decided on the basis of the time point $T_c$ at which a value of said correlation function is maximum decreases gradually to produce a windowed second signal, adding these windowed first and second signals to each other to issue an added result, issuing a third signal subsequent to said first signal for a time-length which is determined on the basis of a desired time-scale modification ratio and a time point $T_c$ at which said correlation function takes a largest value within a time-length of one unitary segment in a manner that a desired time duration/input time duration is realized, repeating the above steps as a next process, setting a starting time point of the first signal in the next process to be a time point at which a starting time point of said first signal is delayed by a time interval such that a desired time-scale modification ratio is produced, and setting a starting time point of the second signal in the next process to be a subsequent time point of a terminal time point of said third signal.

14. Method for modifying speech rate for changing speech reproduction time interval by 1.0 times or more comprising the following steps:

deriving a correlation function in a range shorter than a time length T with respect to a positive direction in which said second signal is moved to a direction with respect to said first signal and a negative direction in which said second signal is moved to an inverse direction of said direction with respect to said first signal from a reference time point at which a starting point of said first signal is in coincidence with a staring point of said second signal, in said first signal of the time length T and said second signal of the time length T, and deriving a time point $T_c$ at which a value of said correlation function becomes a maximum value, displacing said first signal to a time position $T_c$ with respect to said second signal at which said correlation function takes a largest value, multiplying said first signal by a first window function whose amplitude decided on the basis of the time point $T_c$ at which a value of said correlation function is maximum increases gradually to obtain a windowed first signal, multiplying said second signal by a second window function whose amplitude decided on the basis of the time point $T_c$ at which a value of said correlation function is maximum decreases gradually to obtain a windowed second signal, adding said first signal multiplied by said first window function and said second signal multiplied by said second window function to each other to issue an added result, issuing a third signal of a time interval of $\{T/(\alpha-1)+T\}$ time-units subsequent to said first signal, setting a starting time of said first signal in a next process to such a time point that a starting point of said first signal is delayed by a time interval of $\{T/(\alpha-1)\}$ time-units, setting said start time of said second signal in the next process to such a time point that a starting point of said first signal is delayed by a time interval of $\{\alpha T/(\alpha-1)+T\}$ time-units; and repeating all the above-mentioned steps.

15. Method for modifying speech rate as in claim 14, wherein:

said adding step includes, when the time interval of the added result exceeds a time interval of $\{\alpha T/(\alpha-1)\}$ time-units, time-units from the start of said added result, and inhibiting issuance of said third signal.

16. Method for modifying speech rate for changing a speech reproduction time interval of from 0.5 to 1.0 times comprising the following steps:

computing a correlation function between a first signal and a second signal and deriving a time point $T_c$ at which a value of the correlation function is maximum, displacing said second signal with respect to said first signal to a time point $T_c$ at which the correlation function takes a largest value, multiplying said first signal by a first window function whose amplitude decided on the basis of the time point $T_c$ at which a value of said correlation function is maximum decreases gradually to obtain a windowed first signal, multiplying said second signal by a second window function whose amplitude decided on the basis of the time point $T_c$ at which a value of said correlation function is maximum increases gradually to obtain a windowed second signal, adding said first signal multiplied by said first window function and said second signal multiplied by said second window function to each other to issue an added result, issuing a third signal subsequent to said second signal for a time-length which is determined on the basis of a time-scale modification ratio $\alpha$ and a time point $T_c$ at which said correlation function takes a largest value in a manner that a desired time-scale modification ratio $\alpha$ defined as a ratio of output time duration/input time duration is realized, setting a starting time point of said first signal in a next process to be a subsequent time point of a terminal time point of said third signal, and setting a starting time point of said second signal in the next process to be a time point at which a starting time point of said second signal is delayed by a time interval such that a desired time-scale modification ratio is produced.

17. Method for modifying speech rate for changing speech reproduction time interval of from 0.5 to 1.0 times or more comprising the following steps:

deriving a correlation function in a range shorter than a time length T with respect to a positive direction in which said second signal is moved to a direction with respect to said first signal and a negative direction in which said second signal is moved to an inverse direction of said direction with respect to said first signal from a reference time point at which a starting point of said first signal is in coincidence with a starting point of said second signal, in said first signal of the time length T and said second signal of the time length T, and deriving a time point $T_c$ at which a value of said correlation function becomes a maximum value, displacing said second signal to a time position $T_c$ with respect to said first signal at which said correlation function takes a largest value within a time-length of one unitary segment, multiplying said first signal by a first window function whose amplitude decided on the basis of the time point Tc at which a value of said correlation function decreases gradually to obtain a windowed first signal, multiplying said second signal by a second window function whose amplitude decided on the basis of the time point Tc at which a value of said correlation function increases gradually to obtain a windowed second signal, adding said first signal multiplied by said first window function and said second signal multiplied by said second window function to each other to issue an added result, issuing a third signal of a time interval of $\{(2\alpha-1)T/(1-\alpha)-T_c\}$ time-units subsequent to said second signal, wherein $\alpha$ is time-scale modification ratio defined as output time duration/input time duration, setting a starting time of said first signal in a next process to a time point that a starting point of said second signal is delayed by a time interval of $\{\alpha T/(1-\alpha)-T_c\}$ time-units, and setting said starting time of said second signal in the next process to be a time point that said starting point of said second signal is delayed by a time interval of $\{T/(1-\alpha)\}$ time-units, and repeating all the above-mentioned steps.

18. A speech rate modification method in accordance with claim 17, wherein said adding step includes, in case that a time-length of said added result exceeds a time interval of $\{\alpha T/(1-\alpha)\}$ time-units, the added result is issued only for a time interval of $\{\alpha T/(\alpha-1)\}$ time-units from the start of the added result, and issuance of the third signal is inhibited.

19. Method for modifying speech rate for changing a speech reproduction time interval of 0.5 times or less comprising the following steps:

setting initially a starting point of a second signal to a time point that the starting point of a first signal is delayed by such a time interval as to produce a desired time-scale modification ratio $\alpha$ defined as a ratio of output time duration/input time duration, computing a correlation function of said second signal with respect to said first signal and deriving a time point $T_c$ at which a value of the correlation function is maximum, displacing said second signal with respect to said first signal at a time point $T_c$ at which said correlation function takes a largest value within a time-length of one unitary segment, multiplying said first signal by a first window function whose amplitude decided on the basis of the time point $T_c$ at which a value of said correlation function decreases gradually to obtain a windowed first signal, multiplying said second signal by a second window function whose amplitude decided on the basis of the time point $T_c$ at which a value of said correlation function increases gradually to obtain a windowed second signal, adding said first signal multiplied by said first window function and said second signal multiplied by said second window function to each other to obtain an added signal, issuing said added signal as well as a third signal which is subsequent to said second signal, for a time-length such that a desired time-scale modification ratio is made, repeating said computing, displacing, multiplying adding and issuing steps as a next process, setting a starting time of the first signal in a next process to be a next time point of a terminal time point of issued signal, and setting a starting time of the second signal in the next process to be a time point that said starting point of said second signal is delayed by such a time interval as to produce a desired time-scale modification ratio.

20. Method for modifying speech rate for changing speech reproduction time interval of 0.5 times or less comprising the following steps:

setting initially a starting point of a second signal to a time point that starting point of a first signal is delayed by a time interval of $\{(1-\alpha)T/\alpha\}$ time-units, deriving a correlation function in a range shorter than a time length T with respect to a positive direction in which said second signal is moved to a direction with respect to said first signal and a negative direction in which said second signal is moved to an inverse direction of said direction with respect to said first signal from a reference time point at which a starting point of said first signal is in coincidence with a starting point of said second signal, in said first signal of the time length T and said second signal of the time length T, and deriving a time point $T_c$ at which a value of said correlation function becomes a maximum value, displacing said second signal to a time point $T_c$ at which the correlation function takes a largest value within a time-length of one unitary segment, multiplying said first signal by a first window function whose amplitude decided on the basis of the time point $T_c$ at which the value of said correlation function is maximum decreases gradually to obtain a windowed first signal, multiplying said second signal by a second window function whose amplitude decided on the basis of the time point $T_c$ at which the value of said correlation function is maximum increases gradually to obtain a windowed second signal, adding said first signal multiplied by said first window signal and second signal multiplied by said second window signal to each other to issue an added result, issuing, when $T_c$ is negative, a third signal of a time length of $-T_c$ subsequent to said second signal after issuing said added result, issuing, when $T_c$ is zero or positive, said added result for a time length of T time-units from said starting point of the added result, setting a starting time of said first signal in a next process at such a time point that the starting point of the second signal is delayed by a time interval of $\{T-T_c\}$ time-units, setting a starting point of said second signal in the next process at such a time point that the starting point of said second signal is delayed by a time interval of $\{T/\alpha\}$ time-units, and repeating all the above-mentioned steps except for said initial setting.

21. A speech rate modification apparatus comprising:

a demultiplexer having as an input signal a speech signal, as a first output a first segment signal indicative of a first predetermined time length of said input signal, as a second output a second segment signal indicative of a second predetermined time length of said input signal, and as a third output a third segment signal indicative of a time length of said input signal which is determined according to a predetermined time-scale modification ratio ($\alpha$) which represents a ratio of an output time length of an output signal to an input time length of said input signal after said input signal is time-scale-modified;

a correlator comprising means for deriving a correlation function comprising a sum total of products of amplitudes in an overlapped signal formed by overlapping said first segment signal and said second segment signal by shifting said first segment signal and said second segment signal relative to each other by a short time length, and for outputting a time-shift-signal representing a time shift between said first segment signal and said second segment signal when a value of the correlation function represented by said sum total becomes a maximum value;

a window function generator having means for generating a pair of window functions;

a pair of multipliers, respectively receiving said pair of window functions for weighting respective amplitudes of said first segment signal and said second segment signal based on characteristics of said window function;

an adder for adding outputs of said pair of multipliers with a time shift at which the value of said correlation function becomes the maximum value; and a multiplexer responsive to a signal representative of said time-scale modification ratio ($\alpha$), said multiplexer having as a first input an output of said adder, as a second input said third segment signal output from said demultiplexer, and as its output a modified speech signal.

22. A speech rate modification apparatus according to claim 21, further comprising a first memory for storing said first segment signal; and a second memory for storing said second segment signal.

23. A method for modifying speech rate, comprising the steps of:

dividing an input signal into a first segment signal of a first predetermined time length, a second segment signal of a predetermined time length and a third segment signal of a time length which is determined according to a time-scale modification ratio ($\alpha$) which is defined by a ratio of an output time length of an output signal to an input time length of said input signal after said input signal is time-scale-modified, and selectively outputting said first segment signal, said second segment signal and said third segment signal;

deriving a correlation function comprising a sum total of products of amplitudes in an overlapped signal formed by overlapping said first segment signal and said second segment signal by shifting said first segment signal and said second segment signal relative to each other by a short time length, and outputting a time-shift-signal representing a time shift between said first segment signal and said second segment signal when a value of the correlation function represented by said sum total becomes a maximum value, generating a pair of window functions;

weighting respective amplitudes of said first segment signal and said second segment signal, on the basis of characteristics of said window functions to produce weighted first and second segment signals;

adding said weighted first segment signal and said weighted second segment signal with a time shift at which the value of said correlation function becomes the maximum value; and selecting one of said added first segment signal and second segment signal or said third segment signal on the basis of said time-scale modification ratio ($\alpha$).

24. A method for modifying a speech rate according to claim 23, wherein:

said pair of window functions have complimentary characteristics, one of which gradually increases an amplitude of said first segment signal and the other of which gradually decreases the amplitude of said second segment signal, and comprising the further step of repeating said dividing, defining, generating, weighting, adding and selecting steps to vary said output time length of said output signal by said time scale modification ratio ($\alpha$).

25. A method for modifying a speech rate and for changing a speech reproduction time interval by 1.0 times or more, said method comprising the following steps:

computing a correlation function between a first signal and a second signal subsequent to said first signal and deriving a time point which a value of the correlation function is maximum, displacing said first signal with respect to said second signal at a time point at which the correlation function takes a largest value, multiplying said first signal by a window function whose amplitude decided on the basis of the time point at which the value of the correlation function is maximum increases gradually, multiplying said second signal by a window function whose amplitude decided on the basis of the time point at which the value of the correlation function is maximum decreases gradually, adding said first signal multiplied by said window function and said second signal multiplied by said window function to each other and outputting the added signal, issuing a third signal subsequent to said first signal of an original input signal for a time interval decided on the basis of a time-scale modification ratio, setting a starting point of a second signal in a next process to be a subsequent time point of a terminal time point of said third signal, and repeating all the above-mentioned steps.

* * * * *